US010072338B2

(12) United States Patent
Inbe et al.

(10) Patent No.: US 10,072,338 B2
(45) **Date of Patent: *Sep. 11, 2018**

(54) SURFACE CONDITIONING COMPOSITION, METHOD FOR PRODUCING THE SAME, AND SURFACE CONDITIONING METHOD

(75) Inventors: Toshio Inbe, Tokyo (JP); Yusuke Wada, Tokyo (JP); Masanobu Futsuhara, Tokyo (JP)

(73) Assignee: Chemetall GmbH, Frankfurt am Main (DE)

( * ) Notice: Subject to any disclaimer, the term of this patent is extended or adjusted under 35 U.S.C. 154(b) by 0 days.

This patent is subject to a terminal disclaimer.

(21) Appl. No.: 13/414,220

(22) Filed: Mar. 7, 2012

(65) Prior Publication Data

US 2012/0160129 A1 Jun. 28, 2012

Related U.S. Application Data

(63) Continuation of application No. 12/295,800, filed as application No. PCT/JP2007/058221 on Apr. 9, 2007, now abandoned.

(30) Foreign Application Priority Data

Apr. 7, 2006 (JP) ..... 2006-106387

(51) Int. Cl.

| | |
|---|---|
| ***C23C 22/13*** | (2006.01) |
| ***C23C 22/12*** | (2006.01) |
| ***C23C 22/78*** | (2006.01) |

(52) U.S. Cl.
CPC ..... *C23C 22/78* (2013.01)

(58) Field of Classification Search
CPC ..... C23C 22/07–22/23; C23C 22/08; C23C 22/10; C23C 22/12; C23C 22/13;
(Continued)

(56) References Cited

U.S. PATENT DOCUMENTS

| | | | |
|---|---|---|---|
| 6,214,132 | B1 | 4/2001 | Nakayama et al. |
| 6,361,623 | B1 | 3/2002 | Ishikura |

(Continued)

FOREIGN PATENT DOCUMENTS

| | | |
|---|---|---|
| EP | 1 378 586 A1 | 1/2004 |
| EP | 1 566 466 A | 8/2005 |

(Continued)

*Primary Examiner* — Lois Zheng
(74) *Attorney, Agent, or Firm* — Armstrong Teasdale LLP

(57) ABSTRACT

The present invention provides a surface conditioning composition having a surface conditioning function that is even more superior as compared with conventional surface conditioning compositions.

A surface conditioning composition is provided for use in surface conditioning of a metal prior to being subjected to a phosphate-based chemical conversion treatment, in which the surface conditioning composition has a pH of 3 to 12, and includes nearly spherical zinc phosphate particles having an average particle diameter from 0.05 μm to 3 μm, and in which the zinc phosphate particles are produced by mixing at least one kind of zinc compound particles selected from the group consisting of zinc oxide, zinc hydroxide, and basic zinc carbonate with phosphoric acid and/or condensed phosphoric acid to allow for their reaction in an acidic aqueous solution having a pH lower than 7, and dispersing and stabilizing by a dispersion means.

26 Claims, 10 Drawing Sheets

(58) Field of Classification Search
CPC ..... C23C 22/14; C23C 22/16; C23C 22/17; C23C 22/18; C23C 22/20; C23C 22/22; C23C 22/182; C23C 22/184; C23C 22/186; C23C 22/188
USPC ..... 148/253–263
See application file for complete search history.

(56) References Cited

U.S. PATENT DOCUMENTS

| | | | | |
|---|---|---|---|---|
| 6,530,999 | B2 * | 3/2003 | Meagher | C23C 22/12 106/14.12 |
| 7,767,111 | B2 | 8/2010 | Nakazawa | |
| 2004/0011429 | A1 | 1/2004 | Miyamoto | |
| 2005/0187326 | A1 | 8/2005 | Nakazawa | |
| 2006/0113005 | A1 * | 6/2006 | Ando et al. | 148/254 |

FOREIGN PATENT DOCUMENTS

| | | | |
|---|---|---|---|
| JP | 492005 | A1 | 1/1974 |
| JP | 10-245685 | | 9/1998 |
| JP | 2000-096256 | | 4/2000 |
| JP | 2002-060960 | A | 2/2002 |
| WO | WO 98/39498 | | 9/1998 |
| WO | WO 00/05066 | | 2/2000 |

* cited by examiner

Zn-phos raw material China - File: 426-2(060106).raw - Type: 2Th/Th locked - Start: 5.000° - End: 60.000° - Step: 0.010° - Step time: 0.1 s - Operations: Smooth 0.150 | Background 1.000, 1.000 | Import 01-070-1907(C) - Hopeite - Zn3(PO4)2(H2O)4 - Y: 50.00 % - d x by: 1. - WL: 1.5406 - Orthorhombic - a 10.55300 - b 18.19900 - c 5.03100 -

433(ZnO + MDEA + Zr) - File: 433.raw - Type: 2Th/Th locked - Start: 5.000° - End: 60.000° - Step: 0.010° - Step time: 0.1 s - Temp.: 25 °C(R
Operations: Smooth 0.150 | Smooth 0.150 | Background 1.000, 1.000 | Import 01-076-0896(C) - Hopeite - Zn3(PO4)2(H2O)4 - Y: 50.00 % - d x by: 1. - WL: 1.5406 - Orthorhombic - a 10.59700 - b 18.31800 - c 5.03100 -

523 - File: 523.raw - Type: 2Th/Th locked - Start: 5.000° - End: 60.000° - Step: 0.010° - Step time: 0.1 s - Temp.: 25 °C(Room) - Time Start
Operations: Smooth 0.150 | Smooth 0.150 | Smooth 0.150 | Smooth 0.150 |Background 1.000, 1.000 | Import 00-033-1474(*) - Hopeite, syn - Zn3(PO4)2·4H2O - Y: 50.00 % - d x by: 1. - WL: 1.5406 - Orthorhombic - a 10.61100 - b 18.31200 - c 5.0309

24 Dec 2005_syounaiyorozu_minikachi - File: GL1.raw - Type: 2Th/Th locked - Start: 5.000° - End: 60.000° - Step: 0.010° - Step time: 0.1 s - Operations: Smooth 0.150 | Smooth 0.150 |Background 1.000, 1.000 |Background 1.000, 1.000 | Import 00-033-1474(*) - Hopeite, syn - Zn3(PO4)2·4H2O - Y: 50.00 % - d x by: 1. - WL: 1.5406 - Orthorhombic - a 10.61100 - b 18.31200 - c 5.0309

SURFACE CONDITIONING COMPOSITION, METHOD FOR PRODUCING THE SAME, AND SURFACE CONDITIONING METHOD

This application is a continuation of U.S. Ser. No. 12/295,800 filed Sep. 21, 2009, now abandoned hereby incorporated by reference in its entirety for all purposes.

TECHNICAL FIELD

The present invention relates to a surface conditioning composition, and a method for producing the same, and a surface conditioning method.

BACKGROUND ART

Automotive bodies, home electric appliances and the like have been manufactured with metal materials such as steel sheets, galvanized steel sheets, and aluminum alloys. In general, after subjecting to a chemical conversion treatment step as a pretreatment, a treatment such as coating is carried out. As the chemical conversion treatment, a treatment using phosphate is generally carried out. In the chemical conversion treatment with phosphate, a surface conditioning treatment is generally carried out as a pretreatment for allowing fine and compact phosphate crystals to be deposited on the metal materiel surface.

Examples of known surface conditioning compositions for use in such a surface conditioning treatment include treatment liquids containing titanium phosphate particles referred to as a Jernstedt salt, or bivalent or trivalent metal phosphate particles.

For example, a surface conditioning composition is disclosed which includes phosphate particles of at least one kind of bivalent or trivalent metals having a particle diameter of 5 μm or less, and an alkali metal salt or ammonium salt, or a mixture thereof, and which has a pH adjusted to be 4 to 13 (for example, see Patent Document 1).

Also, a surface conditioning composition is disclosed which includes at least one kind of phosphate particles selected from phosphate particles including one or more kind(s) of bivalent and/or trivalent metals, and a variety of accelerator (for example, see Patent Document 2).

[Patent Document 1] Japanese Unexamined Patent Application, First Publication No. Hei 10-245685

[Patent Document 2] Japanese Unexamined Patent Application, First Publication No. 2000-96256

DISCLOSURE OF THE INVENTION

Problems to be Solved by the Invention

However, in accordance with the development of novel materials and simplification of the treatment steps in recent years, there may be a case that such treatment liquids for surface conditioning cannot address satisfactorily. Hence, further improvement of performances of the surface conditioning composition, and improvement of the physical properties of the chemical conversion treatment-coating film obtained by the chemical conversion treatment therewith have been demanded.

For example, high-tensile steel sheets and the like have been known as conversion resistant metal materials, and it is difficult to obtain therefrom a conversion coating film having excellent corrosion resistance by a conventional chemical conversion treatment. Additionally, in the case in which multiple kinds of different metal materials are concurrently subjected to the chemical conversion treatment, the capability of the chemical conversion is significantly deteriorated in the vicinity of the portion where they are in contact. On the other hand, as the level demanded for corrosion resistance has recently been elevating also, formation at a more dense phosphate crystal coating film has been desired.

Furthermore, when zinc phosphate fine particles have been prepared to date, zinc phosphate was pulverized using a polar polymeric dispersant, in general, whereby a substantial period of time has been required for effecting the pulverization. Moreover, thus resulting conversion coating film is more dense than the conversion coating film obtained with a surface conditioning agent including titanium phosphate particles referred to as a Jernstedt salt; however, problems in unevenness of the conversion coating film and susceptibility of rust generation have been involved.

The present invention was made taking into account the current status mentioned above, and an object of the invention is to provide a surface conditioning composition having a surface conditioning function that is even more superior as compared with conventional surface conditioning compositions.

Means for Solving the Problem

The present inventors thoroughly investigated the aforementioned problems to find a solution. Consequently, it was found that the foregoing problems can be solved by a surface conditioning composition that contains nearly spherical zinc phosphate fine particles produced by mixing zinc compound particles, and phosphoric acid and/or condensed phosphoric acid in a certain ratio in an acidic aqueous solution to allow for reaction, and dispersing and stabilizing by a dispersion means. Accordingly, the present invention was accomplished. More specifically, aspects of the present invention are to provide the following.

In a first aspect of the present invention, a surface conditioning composition is provided for use in surface conditioning of a metal prior to being subjected to a phosphate-based chemical conversion treatment, in which the surface conditioning composition has a pH of 3 to 12, and includes nearly spherical zinc phosphate particles having an average particle diameter from 0.05 μm to 3 μm, and in which the zinc phosphate particles are produced by mixing at least one kind of zinc compound particles selected from the group consisting of zinc oxide, zinc hydroxide, and basic zinc carbonate with phosphoric acid and/or condensed phosphoric acid to allow for their reaction in an acidic aqueous solution having a pH lower than 7, and dispersing and stabilizing by a dispersion means.

In a second aspect of the present invention, a surface conditioning composition according to the first aspect further includes at least one of the zinc compound particles, and the phosphoric acid and/or condensed phosphoric acid remaining as an unreacted material in the reaction producing the zinc phosphate particles.

In a third aspect of the present invention, a surface conditioning composition according to the first or second aspect is provided in which the condensed phosphoric acid is pyrophosphoric acid.

In a fourth aspect of the present invention, a surface conditioning composition according to any one of the first to third aspects is provided in which the zinc phosphate particles are obtained by dispersion and stabilization in the presence of an amine compound represented by the following general formula (1):

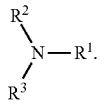

(1)

in which, $R^1$, $R^2$, and $R^3$ each independently represent a hydrogen atom, a straight or branched alkyl group having 1 to 10 carbon atoms, or a straight or branched alkyl group having 1 to 10 carbon atoms and having a hydrophilic functional group in the skeleton thereof. However, $R^1$, $R^2$, and $R^3$ are not all a hydrogen atom.

In a fifth aspect of the present Invention, a surface conditioning composition according to the first to fourth aspects is provided in which the hydrophilic functional group is a hydroxyl group.

In a sixth aspect of the present invention, a surface conditioning composition according to the fourth or fifth aspect is provided in which the amine compound is tertiary alkanolamine.

In a seventh aspect of the present invention, a surface conditioning composition according to any one of the first to sixth aspects further includes at least one selected from the group consisting of an aromatic organic acid, a phenolic compound, and a phenolic resin.

In an eighth second aspect of the present invention, a surface conditioning composition according to any one of the first to seventh aspects further includes at least one selected from the group consisting of a clay compound, fine particles of an oxide, and a water soluble thickening agent.

In a ninth aspect of the present invention, a surface conditioning composition according to any one of the first to eighth aspects further includes at least one selected from the group consisting of a water soluble carboxyl group-containing resin, a saccharide, and a phosphonic acid compound.

In a tenth aspect of the present invention, a surface conditioning composition according to any one of the first to ninth aspects further includes a chelating agent and/or a surfactant.

In an eleventh aspect of the present invention, a surface conditioning composition according to any one of the first to tenth aspects further includes a zirconium complex ion and/or an oxidized metal ion.

In a twelfth aspect of the present invention, a surface conditioning method is provided for use in conditioning of a surface of a metal prior to being subjected to a phosphate-based chemical conversion treatment, in which the method includes a step of bringing a surface conditioning composition according to any one of the first to the eleventh aspects into contact with the surface of the metal.

In a thirteenth aspect of the present invention, a method for production of a surface conditioning composition is provided for use in surface conditioning of a metal prior to being subjected to a phosphate-based chemical conversion treatment, in which the method includes a step of mixing at least one kind of zinc compound particles selected from the group consisting of zinc oxide, zinc hydroxide, and basic zinc carbonate with phosphoric acid and/or condensed phosphoric acid, allowing for reaction in an acidic aqueous solution having a pH of lower than 7, thereby producing nearly spherical zinc phosphate particles having an average particle diameter from 0.05 μm to 3 μm, and dispersing and stabilizing by a dispersion means.

Effect of the Invention

According to the present invention, a surface conditioning composition having an even more superior surface conditioning function as compared with conventional surface conditioning compositions can be provided.

PREFERRED MODE FOR CARRYING OUT THE INVENTION

Embodiments of the present invention are explained below in detail.

Surface Conditioning Composition

The surface conditioning composition according to the present embodiment is for use in surface conditioning of a metal prior to being subjected to a phosphate-based chemical conversion treatment, and is characterized by including nearly spherical zinc phosphate fine particles which were dispersed and stabilized. The surface conditioning composition according to the present embodiment is arbitrarily diluted with water to give a surface conditioning treatment liquid (treatment bath), which is utilized in surface conditioning of a metal prior to being subjected to a phosphate-based chemical conversion treatment.

pH

The surface conditioning composition according to the present embodiment has a pH of 3 to 12, and preferably 7 to 11. When the pH of the surface conditioning composition is higher than 12, zinc may dissolve and result in deterioration of the surface conditioning function, while also in the case of the pH being lower than 3, the surface conditioning function may deteriorate. In addition, in adjusting the pH, for example, NaOH or other commonly used compounds may be used to adjust the pH to fall with in the above range. In other words, a pH within the range in which zinc is insoluble is acceptable. Although favorable performance may be achieved when the pH is approximately 12, an extremely large amount of alkali is required. When the pH is less than 7, the iron sheet may rust, end repulsive forces among particles may be impaired, whereby the stability and chemical conversion properties are likely to deteriorate. Accordingly, the pH is preferably 7 to 11.

Zinc Phosphate Particle

Figure 1:
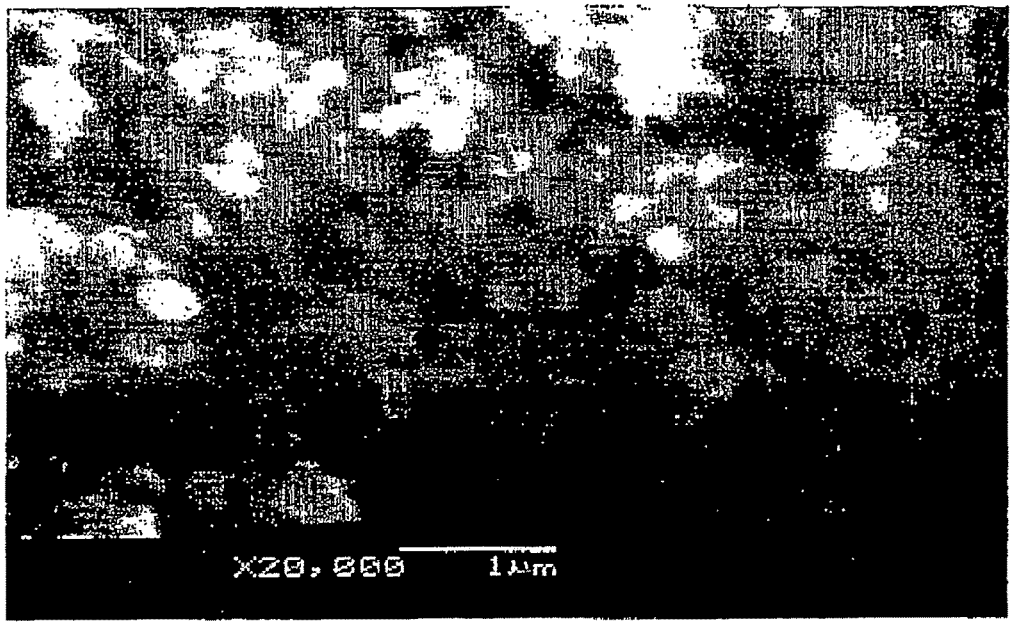
FIG. 1 shows an SEM image of zinc phosphate particles of the present embodiment.

The zinc phosphate particles included in the surface conditioning composition according to the present embodiment may be fine particles having an average particle diameter from 0.05 μm to 3 μm. In addition, their shape is substantially spherical and uniform (shown in FIG. 1). According to conventional surface conditioning composition, in the case in which zinc phosphate particles that are fine having an average particle diameter as small as from 0.05 μm to 3 μm, it was necessary to use an alkali metal salt, negatively charged fine particles of an oxide, and a special dispersant such as a water soluble organic polymer for the purpose of preventing aggregation, sedimentation and the like; however, such a dispersant is not essential in the surface conditioning composition according to the present embodiment. Thus, stabilization of the dispersion is possible without using a dispersant such as a saccharide, organic phosphonic acid, vinyl acetate, polyacrylic acid, and the like. However, use of such a dispersant is not precluded, but such a dispersant can be also used. Although use of such a dispersant is preferred in light of further improvement of the dispersibility of the zinc phosphate particles, such a dispersant may decrease corrosion resistance when it is incorporated in a coating film. Therefore, it is preferred that a dispersant is not used, or used in a small amount when it is to be used.

Figure 2:
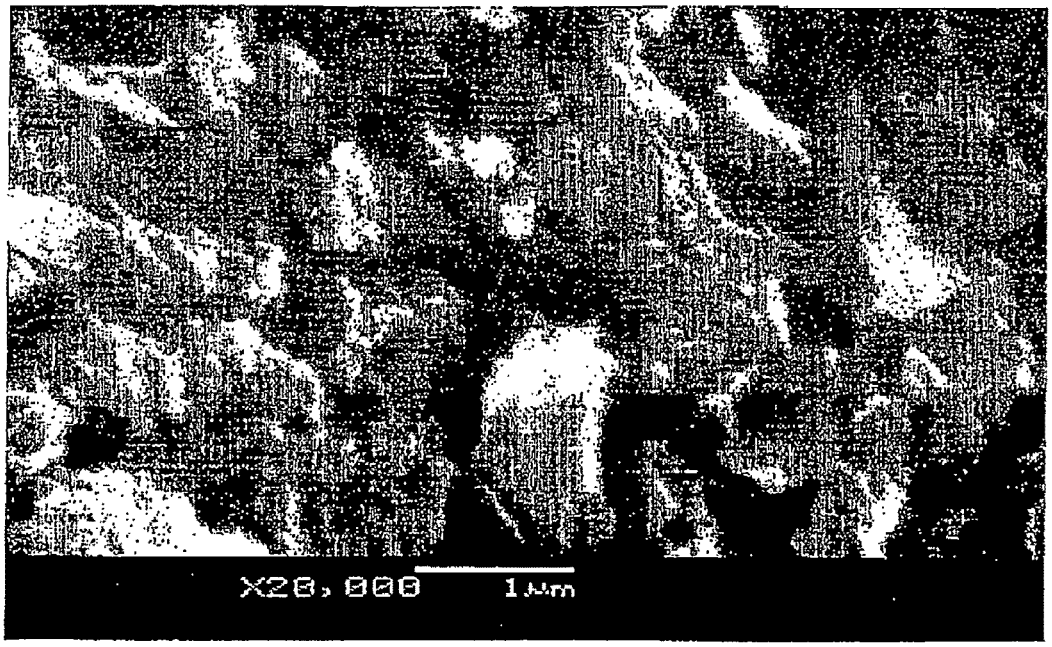
FIG. 2 shows an SEM image of conventional zinc phosphate particles.

More specifically, since the zinc phosphate particles used in the present embodiment have a substantially spherical uniform shape, use of the dispersant as described above is not required. In other words, the zinc phosphate particles included in conventional surface conditioning compositions have a nonuniform shape because they are generated by finely pulverizing commercially available zinc phosphate (shown in FIG. 2); in contrast, since the zinc phosphate particles of the present embodiment have a shape that is substantially spherical and uniform, the repulsive force among the zinc phosphate particles that are present in the surface conditioning composition acts efficiently, thereby resulting in stable dispersion even in the case of fine particles. Therefore, the surface conditioning composition according to the present embodiment can avoid aggregation and sedimentation from occurring without the use of a special dispersant as described above.

As in the foregoing, the zinc phosphate particles used in the present embodiment have an average particle diameter from 0.05 μm to 3 μm, and preferably 0.1 μm to 0.5 μm. When the average particle diameter of the zinc phosphate particles is less than 0.05 μm, a particular method of dispersion is needed, and in addition, a long period of time may be required for the dispersion. Nevertheless, chemical conversion properties as well as stability are less likely to be altered. In contrast, when the zinc phosphate particles have a particle diameter of greater than 3 μm, a dense zinc phosphate crystal coating film cannot be formed. The term "dispersion stability" referred to herein indicates that the dispersed particles do not aggregate or sediment, even if they have been stored for a predetermined time.

The zinc phosphate particles of the present embodiment having a small particle diameter, and having a substantially spherical uniform shape can be readily obtained by producing zinc phosphate in an acidic aqueous solution, accompanied by carrying out dispersion and stabilization by a dispersion means. Specifically, substantially spherical uniform zinc phosphate fine particles may be obtained by mixing zinc compound particles with phosphoric acid and/or condensed phosphoric acid in a specified ratio in an acidic aqueous solution to allow for reaction, and dispersing and stabilizing thereof.

The dispersion means which may be used in the present embodiment is not particularly limited, but conventionally known dispersion means may be employed. Specific examples of the means include bead mills typified by disc type, and pin type, high-pressure homogenizers, ultrasonic dispersion machines and the like.

As the zinc compound particle used in producing the zinc phosphate particle of the present embodiment, at least one selected from the group consisting of zinc oxide, zinc hydroxide, and basic zinc carbonate may be used. These zinc compound particles are dissolved in the acidic aqueous solution, and react with phosphoric acid and/or condensed phosphoric acid to produce zinc phosphate particles, which are dispersed and stabilized by a dispersion means.

The acidic aqueous solution has a pH lower than 7, and preferably 0.5 to 3. When the pH is 7 or higher, the zinc compound particles are not dissolved, leading to the reaction failing to progress, and the zinc phosphate particles not being produced. Accordingly, a desired surface conditioning composition may not be obtained.

The condensed phosphoric acid is believed to be readily coordinated with the zinc phosphate particle in terms of the chemical structure when compared with phosphoric acid; however, when the degree of condensation is too high, improvement of the dispersion stability cannot be expected to the contrary because it becomes difficult to be coordinated. Therefore, as the condensed phosphoric acid, one having a low degree of condensation is preferably used, and pyrophosphoric acid in particularly is preferably used. When pyrophosphoric acid is used, more superior dispersion stability is achieved compared to the case in which phosphoric acid is used. This is speculated to result from the fact that pyrophosphoric acid has a chelating effect that captures hardening components such as magnesium ions and calcium ions in tap water. Therefore, when pyrophosphoric acid is used, aggregation and sedimentation of the zinc phosphate particles can also be prevented in the case in which the hardening components in tap water contaminate the surface conditioning composition.

With respect to the mixing ratio of the zinc compound particles, and the phosphoric acid and/or condensed phosphoric acid, it is preferred that the mass ratio of the zinc element/phosphorus element falls within the range of 0.3 to 30. When this mass ratio is less than 0.3, excess phosphoric acid may reduce the efficiency of dispersion. In addition, when the mass ratio is greater than 30, the desired substantially spherical zinc phosphate fine particles may not be formed. The mass ratio is preferably 1 to 10.

In the reaction to produce the zinc phosphate particles described above, at least one of the zinc compound particles, and the phosphoric acid and/or condensed phosphoric acid remain as an unreacted material depending on the mass ratio of the zinc element/phosphorus element. In the surface conditioning composition of the present embodiment, at least one of these zinc compound particles, and the phosphoric acid and/or condensed phosphoric acid which remain as an unreacted material may be further included.

Amine Compound (a)

It is preferred that the zinc phosphate particles of the present embodiment are dispersed and stabilized in the presence of the amine compound (a) represented by the following general formula (1). The dispersion stability of the zinc phosphate particles can be improved, and the denser zinc phosphate film can be formed, by using this amine compound (a).

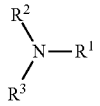

(1)

in which, $R^1$, $R^2$, and $R^3$ each independently represent a hydrogen atom, a straight or branched alkyl group having 1 to 10 carbon atoms, or a straight or branched alkyl group having 1 to 10 carbon atoms and having a hydrophilic functional group in the skeleton thereof; however, $R^1$, $R^2$, and $R^3$ are not all a hydrogen atom.

Although the mechanism through which the amine compound (a) having the above structure obtains a favorable property as a dispersant is unclear, it is speculated to result from its chemical structure. Specifically, the amine compound (a) described above has a nitrogen atom including a lone electron pair, and has a low molecular weight; therefore, it is speculated that the nitrogen atom is coordinated on the surface of the zinc phosphate particle, thereby enhancing the dispersion stability. When the amine compound (a) has additional hydrophilic functional groups in its skeleton, the dispersion stability is further enhanced.

The surface conditioning composition according to the present embodiment is advantageous in that it can be stored far a long period of time, even in the state of a concentrated liquid because the zinc phosphate particles exhibit high dispersion stability. The stability of the surface conditioning treatment liquid (treatment bath) obtained by diluting the surface conditioning composition is also favorable. Furthermore, it is superior in achieving an affect to provide favorable chemical conversion, properties in the chemical conversion reaction, and thus, a conversion coating film of a sufficient amount can be formed, even in the case in which it is applied to conversion resistant metal materials such as high-tensile steel sheets and the like.

The abovementioned amine compound (a) is not particularly limited as long as it is an amine compound represented by the abovementioned general formula (1). The hydrophilic functional group in the general formula (1) is not particularly limited, but may be, for example, a hydroxyl group, carboxyl group, sulfonic acid group, amino group and the like. Among these, a hydroxyl group is preferable, and tertiary alkanolamine is particularly preferably used.

Specific examples of the amine compound (a) include triethylamine, ethylenediamine, 2-ethyldiamine, tri-n-butylamine, n-propylamine, triethylenetetramine, hydrazine, taurine, adipic acid dihydrazide and the like, as well as amino carboxylic acids such as NTA (Nitrilo Triacetic Acid), DTPA (Diethylene Triamine Pentaacetic Acid), EDTA (Ethylene Diamine Tetraacetic Acid), HIDA (Hydroxyethyl Imino Diacetic Acid), DHEG (Dihydroxyethyl Glycine), and the like.

Furthermore, examples of particularly preferably used amine compounds having a hydroxyl group include, for example, aliphatic hydroxyamine compounds such as monoethanolamine, diethanolamine, dimethylethanolamine, methyldiethanolamine, triethanolamine, triisopropanolamine and aminoethylethenolamine; aromatic amine compounds such as amine modified resol and amine modified novolak, and the like. These amine compounds may be used alone, or two or more may be used in combination. Of these, in light of excellent absorptivity to the zinc phosphate particle, difficulty in secondary aggregation, and excellent dispersion stability in liquids, aliphatic hydroxyamine compounds are preferred, and diethanolamine, dimethylethanolamine and triethanolamine are more preferred.

With respect to the content of the amine compound (a), it is preferred that the lower limit be 0.01% by mass, and the upper limit be 1000% by mass on the basis of the mass of the zinc phosphate particles. When the content is less than 0.01% by mass, further enhancement of the dispersion stability is not expected because the amount of adsorption to the zinc phosphate particle becomes insufficient, and also, an additional improvement of the surface conditioning function cannot be expected. Content greater than 1000% by mass is not economical because no effect exceeding the desired effect can be achieved. The lower limit is more preferably 0.1% by mass, while the upper limit is more preferably 100% by mass.

With respect to the amount of addition of the amine compound (a), it is preferred that the lower limit be 0.1% by mass, and the upper limit be 50% by mass in the concentrated liquid. When the amount is less than 0.1% by mass, the dispersion stability may not be satisfactorily enhanced. When the amount is greater than 50% by mass, dispersibility may be deteriorated due to the influence of excess additive, and it would not be economical even if the dispersion were satisfactory. The lower limit is more preferably 0.5% by mass, while the upper limit is more preferably 20% by mass.

With respect to the content of the amine compound, (a), it is preferred that the lower limit be 1 ppm, and the upper limit be 10000 ppm in the surface conditioning treatment bath. When the content is less than 1 ppm, the amount of adsorption to the zinc phosphate particle may be insufficient, whereby secondary aggregation may be likely to occur. Content greater than 10000 ppm is not economical because no effect exceeding the desired effect can be achieved. The lower limit is more preferably 10 ppm, while the upper limit is more preferably 5000 ppm.

Compound (b): Aromatic Organic Acid, Phenolic Compound, Phenolic Resin

The surface conditioning composition according to the present embodiment preferably contains at least one selected from the group consisting of an aromatic organic acid, a phenolic compound, and a phenolic resin. The compound (b) has an effect which allows the zinc phosphate particles to be dispersed and stabilized, similar to the amine compound (a) described above. Moreover, it has a particularly superior property as the surface conditioning agent in the chemical conversion treatment of aluminum-based substrates. More specifically, although conventional surface conditioning agents containing the zinc phosphate particles do not achieve a sufficient effect in the treatment of the aluminum-based substrate, the surface conditioning agent according to the present embodiment can form a favorable conversion coating film.

This may be caused for the following reasons. When a passive coating film constituted of a compound represented by the general formula: $Al(OH)_x$ is formed on the surface of general aluminum-based substrates, the surface conditioning function tends to be markedly deteriorated when surface conditioning is carried out using the surface conditioning composition. It is speculated to result from prevention of the reaction by the passive coating film of such a layer of aluminum hydroxide or the like.

In contrast, because the aforementioned compound (b) is a compound that has a high affinity for aluminum metal, it is speculated that the use of the compound (b) enables the zinc phosphate particles to stably adhered to the substrate surface, and the surface conditioning function is thus improved. In addition, because the compound (b) has a function to chelate cationic components in tap water, the time dependent stability of the treatment bath can be maintained.

The aromatic organic acid is not particularly limited, but benzoic acid, salicylic acid, gallic acid, lignosulfonic acid, and tannic acid are preferably used. Among these, gallic acid, lignosulfonic acid, and tannic acid particular are preferably used.

The phenolic compound is not particularly limited as long as it is a compound having a phenolic hydroxyl group. For example, phenol, catechol, pyrogallol, catechin and flavonoid are preferably used. Of these, catechin in particular is preferably used.

The aforementioned flavonoid is not particularly limited, and examples thereof include flavone, isoflavone, flavonol, flavanone, flavanol, anthocyanidin, aurone, chalcone, epigallocatechin gallate, gallocatechin, theaflavin, daidzin, genistin, rutin, myricitrin, and the like.

Examples of the phenolic resin include polymers having the aromatic organic acid and/or the phenolic compound as a basic skeleton (for example, polyphenolic compounds including tannin, catechin and the like, polyvinyl phenol as well as water soluble resol, novolak resins and the like) and lignin, and the like.

The aforementioned tannin is a generic name of aromatic compounds which have a complicated structure having many phenolic hydroxyl groups, and which have widely distributed in the plant kingdom. The tannin may be either hydrolyzed tannin or condensed tannin. Examples of the tannin include hamameli tannin, persimmon tannin, tea tannin, oak gall tannin, gall nut tannin, myrobalan tannin, divi-divi tannin, algarovllla tannin, valcnia tannin, catechin tannin, and the like. The tannin may also be hydrolyzed tannin yielded by decomposition with a process such as hydrolysis or the like of tannin found in a plant. Additionally, examples of the tannin which can be used also include commercially available ones such as "Tannic acid extract A", "B tannic acid", "N tannic acid", "Industrial tannic acid", "Purified tannic acid", "Hi tannic acid", "F tannic acid", "Official tannic acid" (all manufactured by Dainippon Pharmaceutical Co., Ltd.), "Tannic acid: AL" (manufactured by Fuji Chemical Industry Co., Ltd.), and the like. Two or more kinds of tannin may be concurrently used. For reference, the aforementioned lignin is a network polymer compound involving a phenol derivative, to which a propyl group is bound as a base unit.

With respect to total content of the compound (b), it is preferred that the lower limit be 0.01% by mass, and the upper limit be 1000% by mass on the basis of the mass of the zinc phosphate particles in the metal material surface treatment. When the content is less than 0.01% by mass, the amount of adsorption to the zinc phosphate particles becomes insufficient; therefore, the effect of stabilizing the dispersion and effect of adsorption of the zinc phosphate particles to the metal material cannot be anticipated, and thus, the surface conditioning effect may not be achieved. Content greater than 1000% by mass is not economical because no effect exceeding the desired effect can be achieved. The lower limit is more preferably 0.1% by mass, while the upper limit is more preferably 100% by mass.

With respect to total amount of compound (b) added, it is preferred that the lower limit be 0.1% by mass, and the upper limit be 50% by mass in the concentrated liquid. When the amount is less than 0.1% by mass, the dispersion may not be satisfactorily executed. When the amount is greater than 50% by mass, dispersibility may be deteriorated due to the influence of excess additive, and would not be advantageous economically, even if the dispersion was satisfactory. The lower limit is more preferably 0.5% by mass, while the upper limit is more preferably 20% by mass.

With respect to total content of the compound (b), it is preferred that the lower limit be 1 ppm, and the upper limit be 10000 ppm in the surface conditioning treatment liquid (treatment bath). When the content is less than 1 ppm, the amount of adsorption to the zinc phosphate particles may be insufficient, whereby secondary aggregation may be likely to occur. Content greater than 10000 ppm is not economical because no effect exceeding the desired effect can be achieved. The lower limit is mere preferably 10 ppm, while the upper limit is more preferably 5000 ppm.

Compound (c): Clay Compound, Fine Particle of an Oxide, Water Soluble Thickening Agent It is preferred that the surface conditioning composition according to the present embodiment further contain at least one compound (c) selected from the group consisting of a clay compound, fine particles of an oxide, and a water soluble thickening agent.

The compound (c) greatly improves the chemical conversion property through addition to the surface conditioning composition of the present invention. Furthermore, it is speculated to be responsible far stabilization by way of interactions such as adsorption with the zinc phosphate particles, thereby contributing to stability during storage in the state of an aqueous dispersion liquid (concentrated liquid before use in surface conditioning) for a long period of time, stability of the surface conditioning treatment bath, and stability against hardening components such as calcium ions, magnesium ions, and the like derived from tap water.

Additionally, it is speculated that the zinc phosphate particles become more resistant to sedimentation as compared when the compound (c) is not used because the thickening effect is presumed to result from the compound (c) since the compound (c) interacts with the zinc phosphate particles. Therefore, by further including the compound (c), crystals of more dense conversion coating film can be formed on the surface of a variety of metal materials. In particular, with respect to cold-rolled steel sheets, and galvanized steel sheets, it is preferred in light of ability to uniformly and finely cover the entire face of the metal material.

The aforementioned clay compound is not particularly limited, and examples thereof include smectites such as montmorillonite, beidellite, saponite, and hectorite; kaolinites such as kaolinite, and halloysite; vermiculites such as dioctahedral vermiculite, and trioctahedral vermiculite; micas such as teniolite, tetrasilicic mica, muscovite, illite, sericite, phlogopite, and biotite; hydrotalcite; pyrophilolite;

layered polysilicates such as kanemite, makatite, ilerite, magadiite, and kenyaite, and the like. These clay compounds may be either a naturally occurring mineral, or a synthetic mineral yielded by hydrothermal synthesis, a melt process, a solid phase process, or the like.

Furthermore, it is preferred that the average particle diameter of the clay compound in the dispersed state in water be 0.1 μm or less. When a clay compound having an average particle diameter in the dispersed state in water of greater than 0.1 μm is employed, dispersion stability may be deteriorated. Additionally, the average aspect ratio (mean value of maximum size/minimum size) of the clay compound is more preferably 10 or greater, and still more preferably 20 or greater. When the average aspect ratio is less than 10, the dispersion stability may be deteriorated. The aforementioned average particle diameter in the dispersed state in water can be determined by TEM or SEM following lyophilization of the water dispersion liquid. Also, two or more of these may be concurrently used.

Additionally, intercalation compounds of the aforementioned clay compound (pillared crystals and the like), as well as those subjected to an ion exchange treatment, or to surface modification such as a silane coupling treatment, a composite formation treatment with an organic binder, or the like, can also be used as needed. These clay compounds may be used alone, or two or more thereof may be used in combination. Examples of commercially available product of the saponite include synthetic saponite ("Sumecton SA", trade name, manufactured by Kunimine Industries Co., Ltd.), and the like. Examples of commercially available products of the natural hectorite include "BENTON EW" and "BENTON AD" (both manufactured by ELEMENTIS plc), and the like. Examples of commercially available products of the synthetic hectorite include trade names "Laponite B, S, RD, RDS, XLG, XLS" manufactured by ROOKWOOD Additives Ltd., and the like. These are in the state of a white powder, and readily form sol ("laponite S, RDS, XLS") or gel ("Laponite B, RD, XLG") upon addition to water. Moreover, "Lucentite SWN" of CO-OP Chemical Co., Ltd. may be also exemplified. These natural hectorite and synthetic hectorite may be used alone, or two or more thereof may be used in combination.

The aforementioned fine particles of an oxide are not particularly limited, and examples thereof include silica particles, alumina particles, titania particles, zirconia particles, niobium oxide particles, and the like. The oxide particles suitably have an average particle diameter approximately from 1 nm to 300 nm. These may be used alone, or two or more of them may be used in combination. Among these, in light of thixotropic properties, alumina particles or a silicic acid compound may be preferably used.

The aforementioned water soluble thickening agent is not particularly limited, and examples thereof include a swollen dispersion of fatty amide, amide-based fatty acid such as acrylamide, and polyamide-based thickening agents such as phosphate of long-chain polyaminoamide, urethane-based thickening agents, and polyethylene oxide, and the like. Among these, in light of low probability of inhibiting of the chemical conversion, acrylamide, polyacrylic acid, acrylic acid copolymers are preferably used.

With respect to the content of the compound (c), it is preferred that the lower limit be 0.01% by mass, and the upper limit be 1000% by mass on the basis of the mass of the zinc phosphate particles. When the content is less than 0.01% by mass, the amount of adsorption to the zinc phosphate particles becomes insufficient, whereby the effect of adsorption of the particles to the metal material way not be sufficient, which may lead to incorrectly anticipating the effect of addition. A content of greater than 1000% by mass is not economical because no effect exceeding the desired effect can be achieved. The lower limit is more preferably 0.1% by mass, while the upper limit is more preferably 100% by mass.

With respect to the amount of the compound (c) added, it is preferred that the lower limit be 0.1% by mass and the upper limit be 50% by mass in the concentrated liquid. When the amount is less than 0.1% by mass, the dispersion may not be satisfactory. When the amount is greater than 50% by mass, dispersibility may be deteriorated due to the influence of excess additive, and would not be economical even if the dispersion were satisfactory. The lower limit is more preferably 0.5% by mass, while the upper limit is more preferably 20% by mass.

With respect to the content of the compound (c), it is preferred that the lower limit be 1 ppm and the upper limit be 1000 ppm in the surface conditioning treatment bath. When the content is less than 1 ppm, the amount of adsorption to the zinc phosphate particles may be insufficient; therefore, adsorption and the like of the zinc phosphate particles to the metal material surface may not be facilitated, content greater than 1000 ppm is not economical because no effect exceeding the desired effect can be achieved. The lower limit is more preferably 10 ppm, while the upper limit is more preferably 500 ppm.

It is preferred to include all of the compounds (a) to (c), as described above, in light of further stabilization of the zinc phosphate particles in an aqueous solution, adsorption of the particles to the basal plate, and stability in the concentrated liquid.

Moreover, a variety of components for use in the surface conditioning compositions may be added to the aforementioned surface conditioning composition, in addition to the compounds as described above.

Compound (d)

The aforementioned surface conditioning composition according to the present embodiment may further include at least one compound (d) selected from the group consisting of a water soluble carboxyl group-containing resin, a saccharide, and a phosphonic acid compound.

The compound (d) tends to be negatively charged in a solution, and adhesion or the like of the same to the surface of the zinc phosphate particles may result in electromagnetic repulsion. It is speculated that reaggregation of the zinc phosphate particles is suppressed as a consequence; facilitating adhesion on the metal material surface of the crystal nucleus at a uniform density, and thus a phosphate coating film of a sufficient amount is able to be formed on the metal material surface in the chemical conversion treatment.

The aforementioned compound (d) not only suppresses sedimentation of the zinc phosphate particles in the surface conditioning composition, but also suppresses sedimentation of the zinc phosphate particles in the aqueous dispersion liquid of the zinc phosphate particles (concentrated liquid before use in surface conditioning). Accordingly, long-term storage stability of the concentrated liquid can be maintained.

The water soluble carboxyl group-containing resin is not particularly limited as long as it is a water soluble resin, and examples thereof include resins obtained by polymerization of a monomer, composition containing a carboxyl group-containing ethylenic unsaturated monomer such as (meth) acrylic acid, maleic acid, fumaric acid, and the like. The water soluble carboxyl group-containing resin is preferably a resin that is obtained by radical polymerization of an ethylenic unsaturated monomer composition and has an acid value of 10 to 500. By using such a resin, the dispersion stability of the zinc phosphate particles can be further enhanced. The water soluble carboxyl group-containing resin may be a commercially available product; for example, "Aron A12SL" (manufactured by Toagosei Chemical Industry Co., Ltd.) can be used.

The aforementioned saccharide is not particularly limited, and examples thereof include polysaccharides, polysaccharide derivatives, and alkali metal salts such as sodium salts and potassium salts of the same, and the like. Examples of the polysaccharide include cellulose, methyl cellulose, ethyl cellulose, methylethyl cellulose, hemicellulose, starch, methyl starch, ethyl starch, methylethyl starch, agar, carrageen, alginic acid, pectic acid, guar gum, tamarind seed gum, locust bean gum, konjac mannan, dextran, xanthan gum, pullulan, gellan gum, chitin, chitosan, chondroitin sulfate, heparin, hyaluronic acid, and the like. Moreover, examples of the polysaccharide derivative include the carboxyalkylated or hydroxyalkylated polysaccharides described above such as carboxymethyl cellulose (CMC) and hydroxyethyl cellulose, starch glycolic acid, agar derivatives, carrageen derivatives, and the like.

Examples of the phosphonic acid compound include phosphonic acid and products yielded by direct binding of a carbon atom with a phosphorus atom, as well as amine salts or ammonium salts thereof, excluding phosphoric acid esters.

In the surface conditioning composition as described above, the content of the compound (d) is preferably from 0.01% to 1000% by mass per mass of the zinc phosphate particles. When the content is less than 0.01% by mass, the effect of preventing sedimentation may not be sufficient. Content greater than 1000% by mass is not economical because no effect exceeding the desired effect can be achieved. The concentration is more preferably from 0.1% to 100% by mass.

Furthermore, the content of the compound (d) in the concentrated liquid is preferably from 0.1% to 40% by mass.

The content of the compound (d) is preferably from 1 ppm to 1000 ppm in the surface conditioning treatment bath. When the content is less than 1 ppm, the effect of preventing sedimentation may not be sufficient. Content greater than 1000 ppm is not economical because no effect exceeding the desired effect can be achieved. The concentration is more preferably from 10 ppm to 500 ppm.

Compound (e)

The surface conditioning composition according to the present embodiment may further include a compound (e) that is a chelating agent and/or a surfactant. By including the compound (e), more superior dispersion stability can be imparted, and properties in dispersion stability can be also improved. More specifically, even in the case in which hardening components such as magnesium ions, calcium ions and the like in tap water contaminate the surface conditioning composition, the stability of the surface conditioning treatment bath can be maintained without aggregation of the zinc phosphate particles. Accordingly, the aforementioned chelating agent indicates a compound having the ability to bond with the magnesium ions and calcium ions in an aqueous solution.

The aforementioned chelating agent is not particularly limited, and examples thereof include citric acid, tartaric acid, EDTA, gluconic acid, succinic acid and malic acid, and compounds and derivatives of the same.

The content of the chelating agent is preferably from 1 ppm to 10000 ppm in the surface conditioning treatment bath. When the content is less than 1 ppm, the hardening components in tap water cannot be sufficiently chelated, whereby metal polycations such as calcium ions, which serve as the hardening component, may cause the zinc phosphate particles to aggregate. Content greater than 10000 ppm can achieve no effect exceeding the desired effect, and the chemical conversion properties may be deteriorated through a reaction with active ingredients in the chemical conversion liquid. The content is more preferably from 10 ppm to 1000 ppm.

As the aforementioned surfactant, an anionic surfactant or a nonionic surfactant may be more preferably used.

The aforementioned nonionic surfactant is not particularly limited, but nonionic surfactants having a hydrophilic-lipophilic balance (HLB) of at least 6 are preferred, and examples thereof include polyoxyethylene alkyl ether, polyoxyalkylene alkyl ether, polyoxyethylene derivatives, oxyethylene-oxypropylene block copolymers, sorbitan fatty acid esters, polyoxyethylene sorbitan fatty acid esters, polyoxyethylene sorbitol fatty acid esters, glycerin fatty acid esters, polyoxyethylene fatty acid esters, polyoxyethylene alkylamine, alkylalkanode amide, nonylphenol, alkylnonylphenol, polyoxyalkylene glycol, alkylamine oxide, acetylene diol, polyoxyethylene nonylphenyl ether, silicon based surfactants such as polyoxyethylene alkylphenyl ether-modified silicone, fluorine-based surfactants prepared through substitution of at least one hydrogen atom in a hydrophobic group of a hydrocarbon-based surfactant with a fluorine atom, and the like. Among these, polyoxyethylene alkyl ether and polyoxyalkylene alkyl ether are particularly preferred in light of further achieving the advantageous effect of the present invention.

The aforementioned anionic surfactant is not particularly limited, and examples thereof include fatty acid salts, alkylsulfuric acid ester salts, alkyl ether sulfuric acid ester salts, alkylbenzenesulfonate, alkylnaphthalenesulfonate, alkylsulfosuccinate, alkyldiphenyl ether disulfonate, polybisphenol sulfonate, alkyl phosphate, polyoxyethylalkyl sulfuric acid ester salts, polyoxyethylalkylallylsulfuric acid ester salts, alpha-olefin sulfonate, methyl taurine acid salts, polyasparanate, ether carboxylate, naphthalenesulfonic acid-formalin condensates, polyoxyethylene alkyl phosphoric acid esters, alkyl ether phosphoric acid ester salts, and the like. Among them, alkyl ether phosphoric acid ester salts are preferred in light of further achieving the advantageous effect of the present invention.

With respect to the content of the surfactant, it is preferred that the lower limit be 3 ppm, and the upper limit be 500 ppm in the surface conditioning treatment bath. When the content falls within the above range, the effect of the present invention can be favorably achieved. The lower limit is more preferably 5 ppm, while the upper limit is more preferably 300 ppm. The surfactant may be used alone, or two or more thereof may be used in combination.

Ion (f)

It is preferred that the surface conditioning composition further contains a Zr complex ion and/or an oxidized metal ion (f). The ion (f) may be preferably used in light of eliminating segregation products on the basal plate surface. The oxidized metal ion referred to herein indicates a metal ion having a higher valence in a metal having a plurality of valences. Specific examples include oxidized metal ions of Fe, Mn, Co, Ni, Ce, and the like.

The source of the Zr complex ion is not particularly limited, and examples thereof include zircon hydrofluoride, and zirconium ammonium carbonate; hydroxylated zirconium, zirconium oxycarbonate, basic zirconium carbonate, zirconium borate, zirconium oxalate, zirconium sulfate, zirconium nitrate, zirconyl nitrate, zirconium chloride and the like; and organic zirconium compounds such as dibutyl zirconium dilaurylate, dibutylzirconium dioctate, zirconium naphthenate, zirconium octylate, acetylacetone zirconium, and the like. Among these, zircon hydrofluoride, and zirconyl nitrate are preferably used in light of eliminating segregation products on the basal plate surface.

The source of the oxidized metal ion of Fe is not particularly limited, and examples thereof include water soluble ferric salts such as iron (III) sulfate, iron (III) nitrate, and iron (III) perchlorate; water soluble ferrous salts such as iron (II) sulfate, and iron (II) nitrate, and the like. Among these, ferric nitrate is preferably used in light of oxidation of the basal plate surface.

The source of the oxidized metal ion of Mn is not particularly limited, and examples thereof include organic acid salts such as manganese acetate, manganese benzoate, manganese lactate, manganese formate, and manganese tartrate; halogenated products such as manganese chloride, and manganese bromide; inorganic acid salts such as manganese nitrate, manganese carbonate, manganese phosphate, manganese sulfate, and manganese phosphate; alkoxides such as manganese methoxide; acetylacetone manganese (II), acetylacetone manganese (III), manganese dioxide, manganese oxide, and the like. Among these, potassium permanganate may be preferably used in light of oxidation of the basal plate surface.

The source of the oxidized metal ion of Co is not particularly limited, and examples thereof include cobalt nitrate, cobalt sulfate, and the like.

The source of the oxidized metal ion of Ni is not particularly limited, and examples thereof include carbonates such as nickel (II) carbonate, basic nickel (II) carbonate, and acidic nickel (II) carbonate; phosphates such as nickel (II) phosphate and nickel pyrophosphate; nitrates such as nickel (II) nitrate and basic nickel nitrate; sulfates such as nickel (II) sulfate; oxides such as nickel (II) oxide, trinickel tetraoxide, and nickel (III) oxide; acetates such as nickel (II) acetate and nickel (III) acetate; oxalates such as nickel (II) oxalate; nickel amidosulfate, acetylacetone nickel (II), nickel (II) hydroxide, and the like.

The source of the oxidized metal ion of Ce is not particularly limited, and examples thereof include cerium nitrate, cerium sulfate, and the like.

With respect to the content of the ion (f), it is preferred that the lower limit be 0.01% by mass and the upper limit be 10% by mass in the concentrated liquid. When the content is less than 0.01% by mass, the effect may not be achieved, while content greater than 10% by mass may result in instability of the concentrated liquid.

With respect to the content of the ion (f), it is preferred that the lower limit be 0.1 ppm, and the upper limit be 1000 ppm in the surface conditioning treatment bath. When the content is less than 0.1 ppm, the effect may not be achieved, while content greater than 1000 ppm will not achieve additional effects.

A bivalent or trivalent metal nitrite compound can also be added to the surface conditioning composition according to the present embodiment as needed to still further suppress the generation of rust.

Into the surface conditioning composition according to the present embodiment may be further blended metal alkoxide, a deforming agent, a rust-preventive agent, an antiseptic agent, a thickening agent, an alkaline builder such as sodium silicate, and the like in a range not to inhibit the effect of the present invention, in addition to the components as described above. In order to compensate for uneven degreasing, various surfactants may be added to improve the wettability.

The surface conditioning composition according to the present embodiment can also include a dispersion solvent for allowing the zinc phosphate particles to be dispersed. Examples of the dispersion solvent include aqueous solvents containing 80% by mass or more water, and a variety of water soluble organic solvent other than water; however, the content of the organic solvent is preferred to be as low as possible, which may account for preferably no more than 10% by mass, and more preferably no more than 5% by mass. A dispersion liquid without including any dispersion solvent other than water may also be provided.

The water soluble organic solvent is not particularly limited, and examples thereof include alcohol based solvents such as methanol, ethanol, isopropanol, and ethylene glycol; ether-based solvents such as ethylene glycol monopropyl ether, butyl glycol, and 1-methoxy-2-propanol; ketone-based, solvents such as acetone, and diacetone alcohol; amide-based solvents such as dimethyl acetamide, and methyl pyrrolidone; ester-based solvents such as ethyl carbitol acetate, and the like. These may be used alone, or two or more thereof may be used in combination.

To the surface conditioning composition according to the present embodiment may be further added an alkali salt such as calcined soda for the purpose of stabilizing the zinc phosphate particles, and forming a fine conversion coating film in the phosphate chemical conversion treatment step to be carried out subsequently.

Surface Conditioning Method

The surface conditioning method according to the present embodiment is characterized by including the step of bringing the aforementioned surface conditioning composition in contact with a metal material surface. Hence, a sufficient amount of the zinc phosphate fine particles can adhere to the surface of not only iron-based and zinc-based metal materials, but also to the conversion resistant metal materials such as aluminum and high-tensile steel sheets. Accordingly, a favorable conversion coating film can be formed in the chemical conversion treatment step.

The process for bringing the surface conditioning composition into contact with the metal material surface in the surface conditioning method according to the present embodiment is not particularly limited, but a conventionally known method such as dipping or spraying can be freely employed.

The metal material subjected to the surface conditioning is not particularly limited, but the process can be applied to a variety of metals generally subjected to the phosphate conversion treatment, such as galvanized steel sheets, aluminum-based metal materials such as aluminum and aluminum alloys, magnesium alloys, and iron-based metal materials such as cold-rolled steel sheets and high-tensile steel sheets. Particularly, it can be suitably applied to cold-rolled steel sheets, and high-tensile steel sheets.

Moreover, using the surface conditioning composition as described above, a step of surface conditioning in combination with degreasing can also be carried out. Accordingly, the step for washing with water following a degreasing treatment can be omitted. In the aforementioned step of surface conditioning in combination with degreasing, a known inorganic alkali builder, an organic builder and the like may be added for the purpose of increasing the detergency. Also, a known condensed phosphate or the like may be added. In the surface conditioning as described above, the contact time of the surface conditioning composition with the metal material surface, and the temperature of the surface conditioning composition are not particularly limited, but the process can be performed under conventionally known conditions.

After carrying out the surface conditioning, the phosphate chemical conversion treatment is then carried out to enable production of a phosphate chemical conversion treated metal sheet. The process for the phosphate chemical conversion treatment is not particularly limited, but any one of various known processes such as a dipping treatment, a spraying treatment, or on electrolytic treatment can be employed. Multiple kinds of these treatments may be conducted in combination. In addition, with regard to the phosphate crystal coating film deposited on the metal material surface, it is not particularly limited as long as it is a metal phosphate, and examples thereof include zinc phosphate, iron phosphate, manganese phosphate, calcium phosphate and the like, but not in anyhow limited thereto. In the phosphate chemical conversion treatment, the contact time of the chemical conversion treatment agent with the metal material surface, and the temperature of the chemical conversion treatment agent are not particularly limited, but it can be carried out under conventionally known conditions.

After carrying out the aforementioned surface conditioning and chemical conversion treatment, a coated sheet can be produced by carrying out further coating. In general, electrodeposition coating is employed as the coating process. Paint for use in the coating is not particularly limited, but may be of various types generally used in coating a phosphate chemical conversion treated metal sheet, and examples thereof include epoxymelamine paints, as well as combination of cation electrodeposition coating paint, polyester-based intermediate coating paints, and polyester-based over coating paints, and the like. After the chemical conversion treatment, and prior to the coating, a known process may be employed such as a washing step.

Method for Production of Surface Conditioning Composition

The method for production of the aforementioned surface conditioning composition is characterized by including a step of mixing at least one kind of zinc compound particles selected from the group consisting of zinc oxide, zinc hydroxide, and basic zinc carbonate with phosphoric acid and/or condensed phosphoric acid to allow them to react in an acidic aqueous solution having a pH lower than 7, thereby producing nearly spherical zinc phosphate particles having a particle diameter from 0.05 μm to 3 μm, and dispersing and stabilizing by a dispersion means. In the reaction for producing the zinc phosphate particles, it is preferred that the zinc compound particles are mixed with phosphoric acid and/or condensed phosphoric acid such that the mass proportion of zinc element/phosphorus element falls within the range of 0.3 to 30, thereby allowing for the reaction. Furthermore, by carrying out the dispersion and stabilization of the zinc phosphate particles in this step in the presence of the amine compound (a) described above, the surface conditioning composition that is more superior in the dispersion stability may be produced. The generation of zinc phosphate can be confirmed by an X-ray diffraction method.

More specifically, the surface conditioning composition may be produced according to the following procedures. (i) The zinc compound particles in a specified amount are added to pure water, and the mixture is subjected to prestirring for a specified time with a Disper or the like. When the zinc compound particles are added, the amine compound (a) is preferably added at the same time. (ii) Dispersion is conducted using a dispersion means such as beads. (iii) Next, phosphoric acid and/or condensed phosphoric acid in a specified amounts is gradually added over time while allowing for dispersion, followed by additional dispersion for a specified time, whereby a dispersion liquid of the zinc phosphate particles is obtained. (iv) After diluting the thus resulting dispersion liquid with water to yield a desired zinc phosphate concentration, the desired surface conditioning composition is produced through adjusting the pH of the mixture.

EXAMPLES

The present invention is explained in more detail below by way of Examples, but not as to limit the present invention to these Examples. In the following Example, unless otherwise stated, "part" and "%" represent "part by mass" and "% by mass", respectively.

Example 1

To 67 parts by mass of pure water were added 5 parts by mass of methyldiethanolamine (reagent) and 15 parts by mass of zinc oxide particles (reagent), and the mixture was subjected to prestirring using a Disper at 1500 rpm for 5 minutes. Next, dispersion was initiated with an SG mill having a filling ratio of zirconia beads (1 mm) of 80%. To this mixture was gradually added 13 parts by mass of phosphoric acid (reagent) over 10 minutes while allowing for dispersion, followed by additional dispersion for 180 minutes to obtain a dispersion liquid of the zinc phosphate fine particles. The thus resulting dispersion liquid was poured into a bath with pure water to give a zinc phosphate concentration of 0.1%, and the surface conditioning composition was obtained through adjusting the pH to 9 with NaOH.

Example 2

To 35 parts by mass of pure water were added 10 parts by mass of methyldiethanolamine (reagent) and 30 parts by mass of zinc oxide particles (reagent), and the mixture was subjected to prestirring using a Disper at 2500 rpm for 5 minutes. Next, dispersion was initiated with the SG mill having a filling ratio of zirconia beads (1 mm) of 80%. To this mixture was gradually added 25 parts by mass of phosphoric acid (reagent) over 10 minutes while allowing for dispersion, followed by additional dispersion for 180 minutes to obtain a dispersion liquid of the zinc phosphate fine particles. The thus resulting dispersion liquid was poured into a bath with pure water to give a zinc phosphate concentration of 0.1%, and the surface conditioning composition was obtained through adjusting the pH to 9 with NaOH.

Example 3

To 45 parts by mass of pure water were added 10 parts by mass of methyldiethanolamine (reagent) and 20 parts by mass of zinc oxide particles (reagent), and the mixture was subjected to prestirring using a Disper at 1500 rpm for 5 minutes. Next, dispersion was initiated with the SG mill having a filling ratio of zirconia beads (1 mm) of 80%. To this mixture was gradually added 25 parts by mass of phosphoric acid (reagent) over 10 minutes while allowing for dispersion, followed by additional dispersion for 180 minutes to obtain a dispersion liquid of the zinc phosphate fine particles. The thus resulting dispersion liquid was poured into a bath with pure water to give a zinc phosphate concentration of 0.1%, and the surface conditioning composition was obtained through adjusting the pH to 9 with NaOH.

Example 4

To 40 parts by mass of pure water were added 10 parts by mass of methyldiethanolamine (reagent) and 30 parts by mass of zinc oxide particles (reagent), and the mixture was subjected to prestirring using a Disper at 1500 rpm for 5 minutes. Next, dispersion was initiated with the SG mill having a filling ratio of zirconia beads (1 mm) of 80%. To this mixture was gradually added 20 parts by mass of phosphoric acid (reagent) over 10 minutes while allowing for dispersion, followed by additional dispersion for 180 minutes to obtain a dispersion liquid of the zinc phosphate fine particles. The thus resulting dispersion liquid was poured into a bath with tap water to give a zinc phosphate concentration of 0.1%, and the surface conditioning composition was obtained through adjusting the pH to 9 with NaOH.

Example 5

To 40 parts by mass of pure water were added 10 parts by mass of methyldiethanolamine (reagent), and 30 parts by mass of zinc hydroxide particles (reagent), and the mixture was subjected to prestirring using a Disper at 1500 rpm for 5 minutes. Next, dispersion was initiated with the SG mill having a filling ratio of zirconia beads (1 mm) of 80%. To this mixture was gradually added 20 parts by mass of pyrophosphoric acid (reagent) over 10 minutes while allowing for dispersion, followed by additional dispersion for 180 minutes to obtain a dispersion liquid of the zinc phosphate fine particles. The thus resulting dispersion liquid was poured into a bath with tap water to give a zinc phosphate concentration of 0.1%, and the surface conditioning composition was obtained through adjusting the pH to 9 with NaOH.

Example 6

To 50 parts by mass of pure water were added 5 parts by mass of methyldiethanolamine (reagent) and 30 parts by mass of basic zinc carbonate particles (reagent), and the mixture was subjected to prestirring using a Disper at 1500 rpm for 5 minutes. Next, dispersion was initiated with the SG mill having a filling ratio of zirconia beads (1 mm) of 80%. To this mixture was gradually added 15 parts by mass of pyrophosphoric acid (reagent) over 10 minutes while allowing for dispersion, followed by additional dispersion for 180 minutes to obtain a dispersion liquid of the zinc phosphate fine particles. The thus resulting dispersion liquid was poured into a bath with tap water to give a zinc phosphate concentration of 0.1%, and the surface conditioning composition was obtained through adjusting the pH to 9 with NaOH.

Example 7

To 20 parts by mass of pure water were added 10 parts by mass of methyldiethanolamine (reagent) and 30 parts by mass of zinc hydroxide particles (reagent), and the mixture was subjected to prestirring using a Disper at 1500 rpm for 3 minutes. Next, dispersion was initiated with the SG mill having a filling ratio of zirconia beads (1 mm) of 80%. To this mixture was gradually added 40 parts by mass of pyrophosphoric acid (reagent) over 10 minutes while allowing for dispersion, followed by additional dispersion for 180 minutes to obtain a dispersion liquid of the zinc phosphate fine particles. The thus resulting dispersion liquid was poured into a bath with tap water to give a zinc phosphate concentration of 0.1%, and the surface conditioning composition was obtained through adjusting the pH to 9 with NaOH.

Example 8

To 50 parts by mass of pure water were added 30 parts by mass of zinc hydroxide particles (reagent), and the mixture was subjected to prestirring using a Disper at 1500 rpm for 5 minutes. Next, dispersion was initiated with the SG mill having a filling ratio of zirconia beads (1 mm) of 80%. To this mixture was gradually added 20 parts by mass of pyrophosphoric acid (reagent) over 10 minutes while allowing for dispersion, followed by additional dispersion for 180 minutes to obtain a dispersion liquid of the zinc phosphate fine particles. The thus resulting dispersion liquid was poured into a bath with tap water to give a zinc phosphate concentration of 0.1%, and the surface conditioning composition was obtained through adjusting the pH to 9 with NaOH.

Example 9

To 47 parts by mass of pure water were added 30 parts by mass of zinc hydroxide particles (reagent), and the mixture was subjected to prestirring using a Disper at 1500 rpm for 5 minutes. Next, dispersion was initiated with the SG mill having a filling ratio of zirconia beads (1 mm) of 80%. To this mixture were gradually added 20 parts by mass of pyrophosphoric acid (reagent) and 3 parts by mass of an acrylic dispersant (manufactured by Toagosei Chemical Industry Co., Ltd. "Aron A6020") over 10 minutes while allowing for dispersion, followed by additional dispersion for 180 minutes to obtain a dispersion liquid of the zinc phosphate fine particles. The thus resulting dispersion liquid was poured into a bath with tap water to give a zinc phosphate concentration of 0.1%, and the surface conditioning composition was obtained through adjusting the pH to 9 with NaOH.

Example 10

To 49 parts by mass of pure water were added 5 parts by mass of methyldiethanolamine (reagent) and 30 parts by mass of basic zinc carbonate particles (reagent), and the mixture was subjected to prestirring using a Disper at 1500 rpm for 5 minutes. Next, dispersion was initiated with the SG mill having a filling ratio of zirconia beads (1 mm) of 80%. To this mixture were gradually added 15 parts by mass of pyrophosphoric acid (reagent) and 1 part by mass of 40% zircon hydrofluoric acid (reagent) over 10 minutes while allowing for dispersion, followed by additional dispersion for 180 minutes to obtain a dispersion liquid of the zinc phosphate fine particles. The thus resulting dispersion liquid was poured into a bath with tap water to give a zinc phosphate concentration of 0.1%, and the surface conditioning composition was obtained through adjusting the pH to 9 with NaOH.

Example 11

To 48.5 parts by mass of pure water were added 5 parts by mass of dimethylethanolamine (reagent) and 30 parts by mass of basic zinc carbonate particles (reagent), and the mixture was subjected to prestirring using a Disper at 1500 rpm for 5 minutes. Next, dispersion was initiated with the SG mill having a filling ratio of zirconia beads (1 mm) of 80%. To this mixture were gradually added 15 parts by mass of pyrophosphoric acid (reagent) and 1.5 parts by mass of gallic acid (reagent) over 10 minutes while allowing for dispersion, followed by additional dispersion for 180 minutes to obtain a dispersion liquid of the zinc phosphate fine particles. The thus resulting dispersion liquid was poured into a bath with tap water to give a zinc phosphate concentration of 0.1%, and the surface conditioning composition was obtained through adjusting the pH to 9 with NaOH.

Example 12

To 49 parts by mass of pure water were added 5 parts by mass of diethanolamine (reagent) and 30 parts by mass of basic zinc carbonate particles (reagent), and the mixture was subjected to prestirring using a Disper at 1500 rpm for 5 minutes. Next, dispersion was initiated with the SG mill having a filling ratio of zirconia beads (1 mm) of 80%. To this mixture were gradually added 15 parts by mass of pyrophosphoric acid (reagent) and 1 part by mass of epicatechin (reagent) over 10 minutes while allowing for dispersion, followed by additional dispersion for 180 minutes to obtain a dispersion liquid of the zinc phosphate fine particles. The thus resulting dispersion liquid was poured into a bath with tap water to give a zinc phosphate concentration of 0.1%; and the surface conditioning composition was obtained through adjusting the pH to 9 with NaOH.

Example 13

To 49 parts by mass of pure water were added 5 parts by mass of triethanolamine (reagent) and 30 parts by mass of basic zinc carbonate particles (reagent), and the mixture was subjected to prestirring using a Disper at 1500 rpm for 5 minutes. Next, dispersion was initiated with the SG mill having a filling ratio of zirconia beads (1 mm) of 80%. To this mixture were gradually added 15 parts by mass of pyrophosphoric acid (reagent) and 1 part by mass of saponite (manufactured by Kunimine industries Co., Ltd., "Sumecton SA") over 10 minutes while allowing for dispersion, followed by additional dispersion for 180 minutes to obtain a dispersion liquid of the zinc phosphate fine particles. The thus resulting dispersion liquid was poured into a bath with tap water to give a zinc phosphate concentration of 0.1%, and the surface conditioning composition was obtained through adjusting the pH to 9 with NaOH.

Example 14

To 49 parts by mass of pure water were added 5 parts by mass of methyldiethanolamine (reagent) and 30 parts by mass of basic zinc carbonate particles (reagent), and the mixture was subjected to prestirring using a Disper at 1500 rpm for 5 minutes. Next, dispersion was initiated with the SG mill having a filling ratio of zirconia beads (1 mm) of 80%. To this mixture were gradually added 15 parts by mass of pyrophosphoric acid (reagent) and 1 part by mass of 3-mercaptopropylmethyl dimethoxysilane (reagent) over 10 minutes while allowing for dispersion, followed by additional dispersion for 180 minutes to obtain a dispersion liquid of the zinc phosphate fine particles. The thus resulting dispersion liquid was poured into a bath with tap water to give a zinc phosphate concentration of 0.1%, and the surface conditioning composition was obtained through adjusting the pH to 9 with NaOH.

Example 15

To 48.5 parts by mass of pure water were added 5 parts by mass of ethylenediamine (reagent) and 30 parts by mass of basic zinc carbonate particles (reagent), and the mixture was subjected to prestirring using a Disper at 1500 rpm for 5 minutes. Next, dispersion was initiated with the SG mill having a filling ratio of zirconia beads (1 mm) of 80%. To this mixture were gradually added 15 parts by mass of pyrophosphoric acid (reagent) and 1.5 parts by mass of epicatechin (reagent) over 10 minutes while allowing for dispersion, followed by additional dispersion for 180 minutes to obtain a dispersion liquid of the zinc phosphate fine particles. The thus resulting dispersion liquid was poured into a bath with tap water to give a zinc phosphate concentration of 0.1%; and the surface conditioning composition was obtained through adjusting the pH to 9 with NaOH.

Example 16

To 50 parts by mass of pure water were added 10 parts by mass of methyldiethanolamine (reagent) and 30 parts by mass, of zinc hydroxide particles (reagent), and the mixture was subjected to prestirring using a Disper at 1500 rpm for 5 minutes. Next, dispersion was initiated with the SG mill having a filling ratio of zirconia beads (1 mm) of 80%. To this mixture was gradually added 10 parts by mass of pyrophosphoric acid (reagent) over 10 minutes while allowing for dispersion, followed by additional dispersion for 180 minutes to obtain a dispersion liquid of the zinc phosphate fine particles. The thus resulting dispersion liquid was poured into a bath with tap water to give a zinc phosphate concentration of 0.1%, and the surface conditioning composition was obtained through adjusting the pH to 9 with NaOH.

Comparative Example 1

To pure water were added 30 parts by mass of zinc phosphate particles (reagent), 1 part by mass of tribasic sodium phosphate (reagent), and 1 part by mass of finely powdered silica (manufactured by Nippon Aerosil Co., Ltd., "Aerosil 300") to make 100 parts by mass. Next, dispersion was carried out with the SG mill having a filling ratio of zirconia beads (1 mm) of 80% for 180 minutes. The thus resulting dispersion liquid was poured into a bath with tap water to give a zinc phosphate concentration of 0.1%, and the surface conditioning composition was obtained through adjusting the pH to 9 with NaOH.

Comparative Example 2

To pure water were added 30 parts by mass of zinc phosphate particles (reagent), and 1 part by mass of carboxymethyl cellulose (CMC: manufactured by Nippon Paper Chemicals Co., Ltd., "Sunrose APP84") to make 100 parts by mass. Next, dispersion was carried out with the SG mill having a filling ratio of zirconia beads (1 mm) of 80% for 180 minutes. The thus resulting dispersion liquid was poured into a bath with tap water to give a zinc phosphate concentration of 0.1%, and the surface conditioning composition was obtained through adjusting the pH to 9 with NaOH.

Comparative Example 3

To pure water were added 30 parts by mass of zinc phosphate particles (reagent), and 1 part by mass of polyacrylic acid (manufactured by Nihon Junyaku Co.; Ltd., "JURYMER AC10L") to make 100 parts by mass. Next, dispersion was carried out with the SG mill having a filling ratio of zirconia beads (1 mm) of 80% for 180 minutes. The thus resulting dispersion liquid was poured into a bath with tap water to give a zinc phosphate concentration of 0.1%, and the surface conditioning composition was obtained through adjusting the pH to 9.

Comparative Example 4

As a titanium-based surface conditioning composition, "Surf fine 5N10", manufactured by Nippon Paint Co., Ltd. was poured into a bath with tap water to give a concentration of 0.1%, and the surface conditioning composition was obtained through adjusting the pH to 9 with NaOH.

Comparative Example 5

To pure water were added 30 parts by mass of zinc phosphate particles (reagent), 3 parts by mass of a polyacrylic acid-based dispersant (manufactured by Toagosei Chemical Industry Co., Ltd. "Aron A6020"), and 1 part by mass of bentonite (reagent) to make 100 parts by mass. Next, dispersion was carried out with the SG mill having a filling ratio of zirconia beads (1 mm) of 80% for 180 minutes. The thus resulting dispersion liquid was poured into a bath with tap water to give a zinc phosphate concentration of 0.1%, and the surface conditioning composition was obtained through adjusting the pH to 9.

Production of Test Sheet 1

A cold-rolled steel sheet (SPC) (70 mm×150 mm×0.8 mm), a high-tensile steel sheet (70 mm×150 mm×1.0 mm), as well as an aluminum sheet (70 mm×150 mm×1.0 mm) and a galvanized steel sheet (GA) (70 mm×150 mm×0.8 mm), which had been laid on each half, and fixed by clamping with clips on two sides to provide an aluminum-electrically modified part (a part where the aluminum and galvanized steel sheets are in contact), were prepared. Each was subjected to a degreasing treatment using a degreasing agent ("SURFCLEANER EC92", trade name, manufactured by Nippon Paint Co., Ltd.) at 40° C. for 2 minutes. Then, using each of the surface conditioning composition of Examples 1 to 16 and Comparative Examples 1 to 5 obtained as described above, the surface conditioning treatment was carried out at room temperature for 30 seconds. The constitutions of the surface conditioning compositions obtained as in the abovementioned are shown in Table 1. Subsequently, each metal sheet was subjected to a chemical conversion treatment using a zinc phosphate treatment liquid "SURFDINE 6350", trade name, manufactured by Nippon Paint Co., Ltd.) by a dipping method at 35° C. for 2 minutes, followed by washing with water, washing with pure water, and drying to obtain a test sheet.

Evaluation Test

According to the following methods, average particle diameter, dispersion stability, and working properties of the resulting compositions for surface conditioning were determined, and various evaluations of the test sheets thus obtained were conducted.

Average Particle Diameter of Zinc Phosphate Particles

With respect to the average particle diameter of the zinc phosphate particles included in the surface conditioning composition obtained in Examples 1 to 16 and Comparative Examples 1 to 5, determination was conducted using an electrophoretic light scattering photometer ("Photal ELS~500", trade name, manufactured by Otsuka Electronics Co., Ltd.). The results are shown in Table 1.

Zinc Phosphate Crystal

Whether or not crystals of zinc phosphate were generated in Examples was ascertained by X-ray diffractometric determination. For the determination, an X-ray diffractometer "GeigerFlex RAD-2B" manufactured by Rigaku Corporation was used. The results are shown in Table 1.

Amount of Conversion Coating Film

Using a fluorescent X-ray measuring apparatus ("XRF-1700", trade name, manufactured by Shimadzu Corporation), the mass of the conversion coating film was measured with the amount of element P included in the conversion coating film obtained in Examples and Comparative Examples as a marker. The results ere shown in Table 1.

Crystal of Coating Film

The appearance of the crystals of the conversion coating film obtained in Examples and Comparative Examples was visually evaluated on the basis of the following standards. In addition, the size of the crystals of the formed conversion coating film was measured with an electron microscope "JSM-5600LV" manufactured by JEOL DATUM LTD. The results are shown in Table 1.

A: uniformly and finely formed on the entire face
B: roughly formed on the entire face
C: not formed in parts
D: almost no conversion coating film formed Working Properties With respect to the working properties, evaluation was made in light of chemical conversion unevenness, generation of rust, particle diameter attained by dispersion for a short period of time. The evaluation standards or evaluation method of each evaluation were as follows. The evaluation of the chemical conversion unevenness and generation of rust was made using the conversion coating film formed on SPC.

Chemical Conversion Unevenness

A: unevenness found among parts subjected to the chemical conversion treatment with vigorous stirring and other parts B: Slight unevenness found among parts subjected to the chemical conversion treatment with vigorous stirring and other parts C: almost no unevenness found among parts subjected to the chemical conversion treatment with vigorous stirring and other parts Generation of Rust A: no rust generated B: slight rust stains generated C: rust stains generated on the entire surface Average Particle Diameter Attained by Dispersion for a Short Period of Time On each of the Examples and Comparative Examples, the average particle diameter 60 minutes after initiation of the dispersion was measured using an electrophoretic light scattering photometer ("Photal ELS-800", trade name, manufactured by Otsuka Electronics Co., Ltd.). In the Table, "-" represents that the evaluation was not made.

Dispersion Stability

The compositions for surface conditioning obtained in the Examples and Comparative Examples were left to stand at 40° C. for 30 days, and the appearance and performance were then evaluated according to the following standards. The evaluation was made at a concentration of 30% and a concentration of 45%, respectively. The results are shown in Table 1.

A: no abnormal appearance found, without alteration of the chemical conversion performance from the initial product B: visible separation, without alteration of the chemical conversion performance from the initial product C: sedimentation found, chemical conversion failed -: not evaluated Corrosion Resistance The conversion coating films (SPC used) obtained in the Examples and Comparative Examples were sealed with a tape, and cross cuts were made with a cutter, whereby a CCT test was carried out. More specifically, in a saline spray test device maintained at a temperature of 35° C. with a humidity of 95%, a 5% aqueous solution of NaCl maintained at a temperature of 35° C. was continuously sprayed for 2 hours. Next, after drying under the conditions of a temperature of 60° C. with a humidity of 20 to 30% for 4 hours, the test piece was maintained under humid conditions at 50° C., with a humidity of or higher for 2 hrs. These steps were specified as one cycle, and the width of the blister of the coated film was measured following 200 cycles. The results are shown in Table 1.

TABLE 1

| | Zinc Compound | Acid | Amine | Additive | pH | Particle Diameter (mM) | XD (X-Ray Diffraction) |
|---|---|---|---|---|---|---|---|
| Example 1 | zinc oxide (15) | phosphoric acid (30) | MDEA(5) | — | 9 | 0.7 | $Zn_3(PO_4)_2(H_2O)_4$ |
| Example 2 | zinc oxide (30) | phosphoric acid (25) | MDEA(10) | — | 9 | 0.38 | $Zn_3(PO_4)_2(H_2O)_4$ |
| Example 3 | zinc oxide (20) | phosphoric acid (25) | MDEA(10) | — | 9 | 0.44 | $Zn_3(PO_4)_2(H_2O)_4$ |
| Example 4 | zinc oxide (20) | pyrophosphoric acid (20) | MDEA(10) | — | 9 | 0.44 | $Zn_3(PO_4)_2(H_2O)_4$ |
| Example 5 | zinc hydroxide (30) | pyrophosphoric acid (20) | MDEA(10) | — | 9 | 0.30 | $Zn_3(PO_4)_2(H_2O)_4$ |
| Example 6 | basic zinc carbonate (30) | pyrophosphoric acid (15) | MDEA(5) | — | 9 | 0.30 | $Zn_3(PO_4)_2(H_2O)_4$ |
| Example 7 | zinc hydroxide (30) | pyrophosphoric acid (40) | MDEA(10) | — | 9 | 2.2 | $Zn_3(PO_4)_2(H_2O)_4/Zn_2P_2O_7$ |
| Example 8 | zinc hydroxide (30) | pyrophosphoric acid (20) | — | — | 9 | 1.6 | $Zn_3(PO_4)_2(H_2O)_4$ |
| Example 9 | zinc hydroxide (30) | pyrophosphoric acid (20) | — | acrylic acid-based dispersant | 9 | 0.35 | $Zn_3(PO_4)_2(H_2O)_4$ |
| Example 10 | basic zinc carbonate (30) | pyrophosphoric acid (15) | MDEA(5) | zircon hydrofluoric acid | 9 | 0.30 | $Zn_3(PO_4)_2(H_2O)_4$ |
| Example 11 | basic zinc carbonate (30) | pyrophosphoric acid (15) | DMEA(5) | gallic acid (1.5) | 8 | 0.30 | $Zn_3(PO_4)_2(H_2O)_4$ |
| Example 12 | basic zinc carbonate (30) | pyrophosphoric acid (15) | DEA(5) | epicatechin (1) | 0 | 0.30 | $Zn_3(PO_4)_2(H_2O)_4$ |
| Example 13 | basic zinc carbonate (30) | pyrophosphoric acid (15) | TEA(5) | saponite (1) | 8 | 0.30 | $Zn_3(PO_4)_2(H_2O)_4$ |
| Example 14 | basic zinc carbonate (30) | pyrophosphoric acid (15) | MDEA(5) | 3MPMDMS(1) | 9 | 0.30 | $Zn_3(PO_4)_2(H_2O)_4$ |
| Example 15 | basic zinc carbonate (30) | pyrophosphoric acid (15) | EDA(6) | epicatechin (1.5) | 9 | 0.30 | $Zn_3(PO_4)_2(H_2O)_4$ |
| Example 16 | zinc hydroxide (30) | pyrophosphoric acid (10) | MDEA(10) | — | 9 | 0.30 | $Zn_3(PO_4)_2(H_2O)_4/ZnO$ |
| Comparative Example 1 | zinc phosphate (30) | tribasic phosphoric acid Na (1) | — | $SiO_2$(1) | 9 | 8 | $Zn_3(PO_4)_2(H_2O)_4$ |
| Comparative Example 2 | zinc phosphate (30) | — | — | CMC(1) | 0 | 0.7 | $Zn_3(PO_4)_2(H_2O)_4$ |
| Comparative Example 3 | zinc phosphate (30) | — | — | polyacrylic acid (1) | 9 | 0.8 | $Zn_3(PO_4)_2(H_2O)_4$ |
| Comparative | | Surf fine 5N-10 | | | 8 | — | — |

TABLE 1-continued

| | | | | | | | | |
|---|---|---|---|---|---|---|---|---|
| Example 4 | zinc phosphate (30) | — | — | acrylic acid-based dispersant (3) bentorite (1) | 0 | 0.7 | $Zn_3(PO_4)_2(H_2O)_4$ |
| Comparative Example 5 | | | | | | | |

| | SPC | | High-Tensile Steel Plate | Al-electrically modified part | | Working properties | | | | | |
|---|---|---|---|---|---|---|---|---|---|---|---|
| | Coating Film | Amount of Coating | Coating Film | Coating Film | Amount of Coating | Coating Film | | Dispersion for a Short | Stability | | Occasion |
| | Crystal | Film | Crystal | Crystal | Film | Unevenness | Rust | Period | 30% | 45% | Recitation |
| Example 1 | A | 1.7 | A | A | 1 | A | A | 0.98 | — | — | 8 |
| Example 2 | A | 1.6 | A | A | 1.1 | A | A | 0.52 | B | B | 7 |
| Example 3 | A | 1.7 | A | A | 1 | A | A | 0.59 | B | B | 7 |
| Example 4 | A | 1.5 | A | A | 1.2 | A | A | 0.61 | B | B | 8 |
| Example 5 | A | 1.2 | A | A | 1.1 | A | A | 0.49 | B | B | 8 |
| Example 6 | A | 1.2 | A | A | 1.2 | A | A | 0.5 | B | B | 9 |
| Example 7 | B | 1.9 | B | B | 1 | A | A | — | — | — | 9 |
| Example 8 | B | 1.9 | B | B | 1 | A | A | — | — | — | 9 |
| Example 9 | A | 1.5 | A | A | 1.2 | B | B | 0.49 | — | — | 8 |
| Example 10 | A | 1 | A | A | 1.1 | A | A | 0.52 | B | B | 7 |
| Example 11 | A | 1 | A | A | 1.3 | A | A | 0.52 | B | B | 9 |
| Example 12 | A | 1 | A | A | 1.3 | A | A | 0.48 | B | B | 9 |
| Example 13 | A | 1.2 | A | A | 1.1 | A | A | 0.51 | B | B | 9 |
| Example 14 | A | 1.1 | A | A | 1.1 | A | A | 0.47 | B | B | 6 |
| Example 15 | A | 1 | A | A | 1.3 | A | A | 0.53 | B | B | 9 |
| Example 16 | A | 1.2 | A | A | 1.1 | A | A | 0.49 | A | B | 8 |
| Comparative Example 1 | adhesion not found | adhesion not found | adhesion not found | adhesion not found | adhesion not found | adhesion not found | adhesion not found | — | C | solidified | — |
| Comparative Example 2 | B | 2.3 | C rust | adhesion not found | adhesion not found | B | B | 1.35 | B | solidified | 12 |
| Comparative Example 3 | B | 2.2 | C rust | adhesion not found | adhesion not found | B | C | 1.29 | B | solidified | 12 |
| Comparative Example 4 | B | 2.1 | C rust | adhesion not found | adhesion not found | A | A | — | Powder | Powder | 12 |
| Comparative Example 5 | A | 1.7 | B | C | 0.6 | C | C | 1.38 | B | solidified | 11 |

Figure 3:
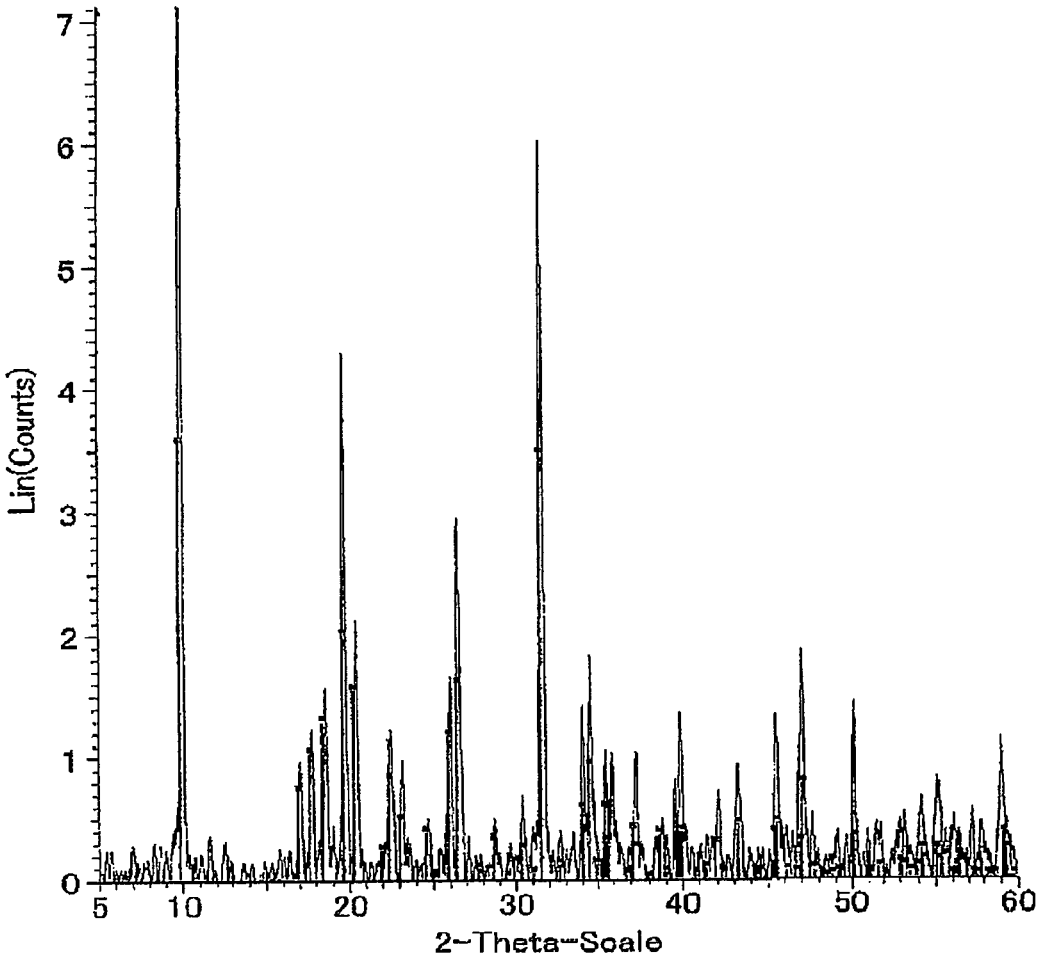
FIG. 3 shows an X-ray diffraction spectrum according to Example 2.
Figure 4:
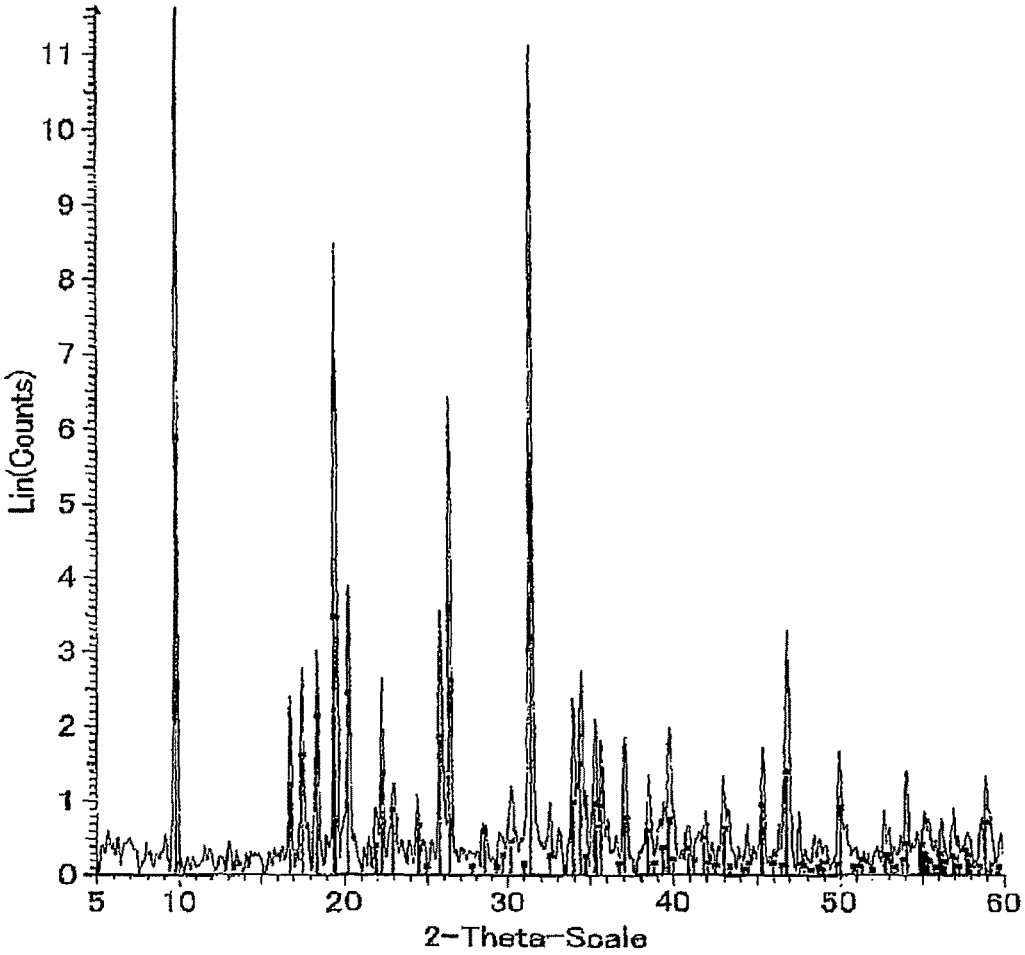
FIG. 4 shows an X-ray diffraction spectrum according to Example 3.
Figure 5:
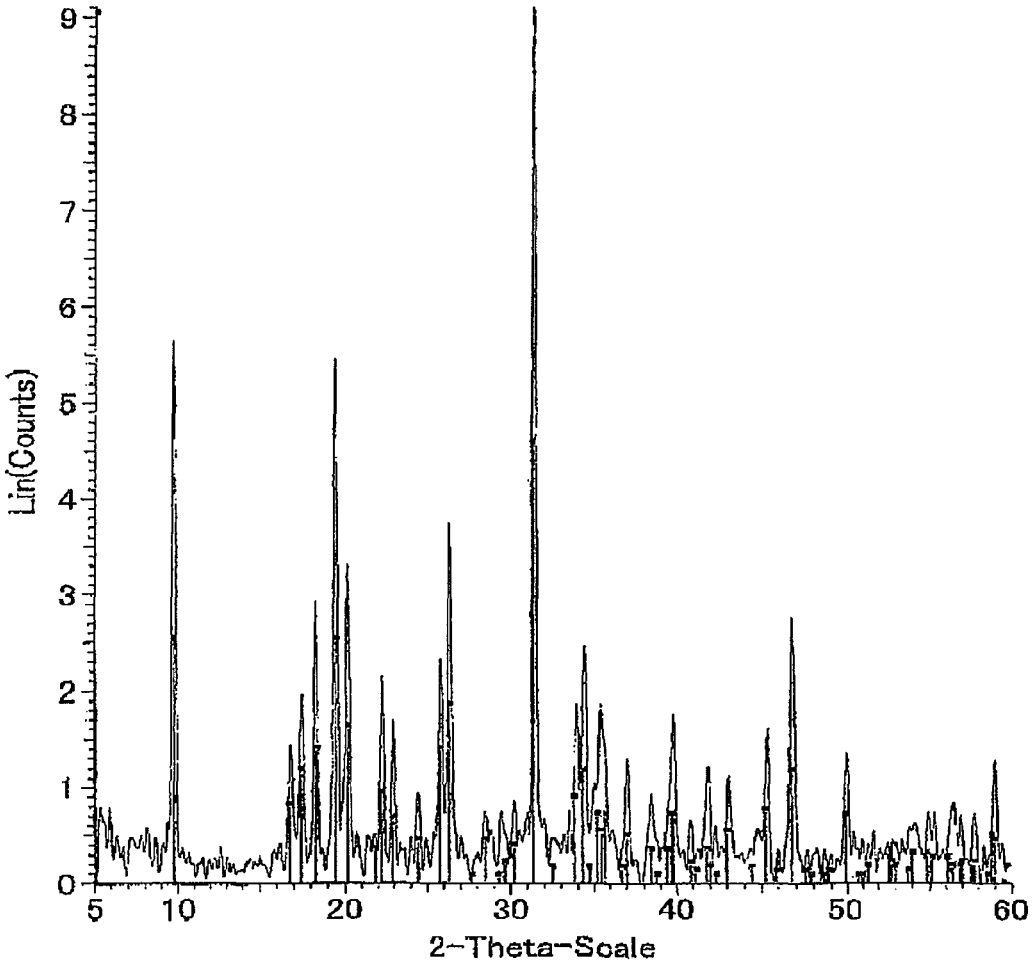
FIG. 5 shows an X-ray diffraction spectrum according to Example 4.
Figure 6:
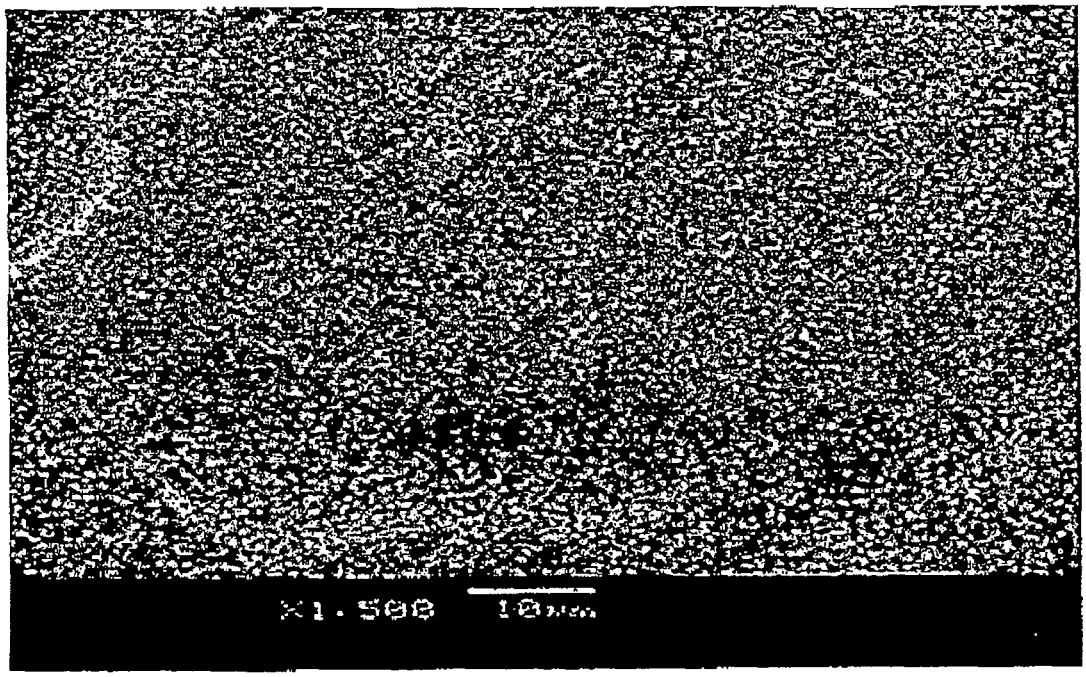
FIG. 6 shows an electron microscope photograph of the chemical conversion coating film formed on the cold-rolled steel sheet, using the surface conditioning composition according to Example 6.
Figure 7:
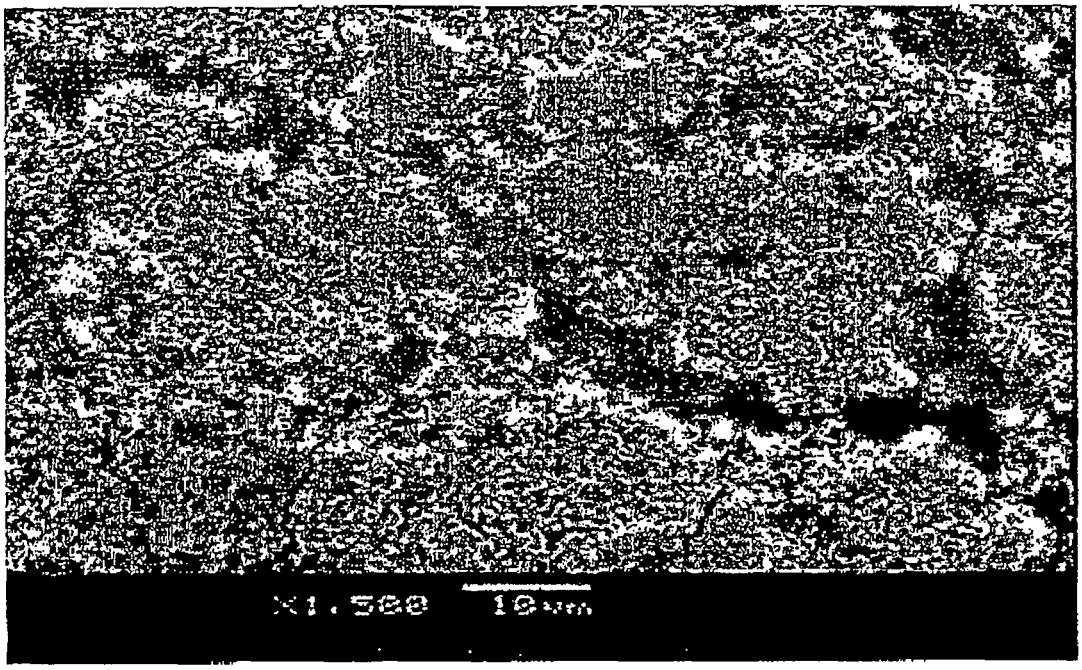
FIG. 7 shows an electron microscope photograph of the chemical conversion coating film formed on the galvanized steel sheet, using the surface conditioning composition according Example 6.
Figure 8:
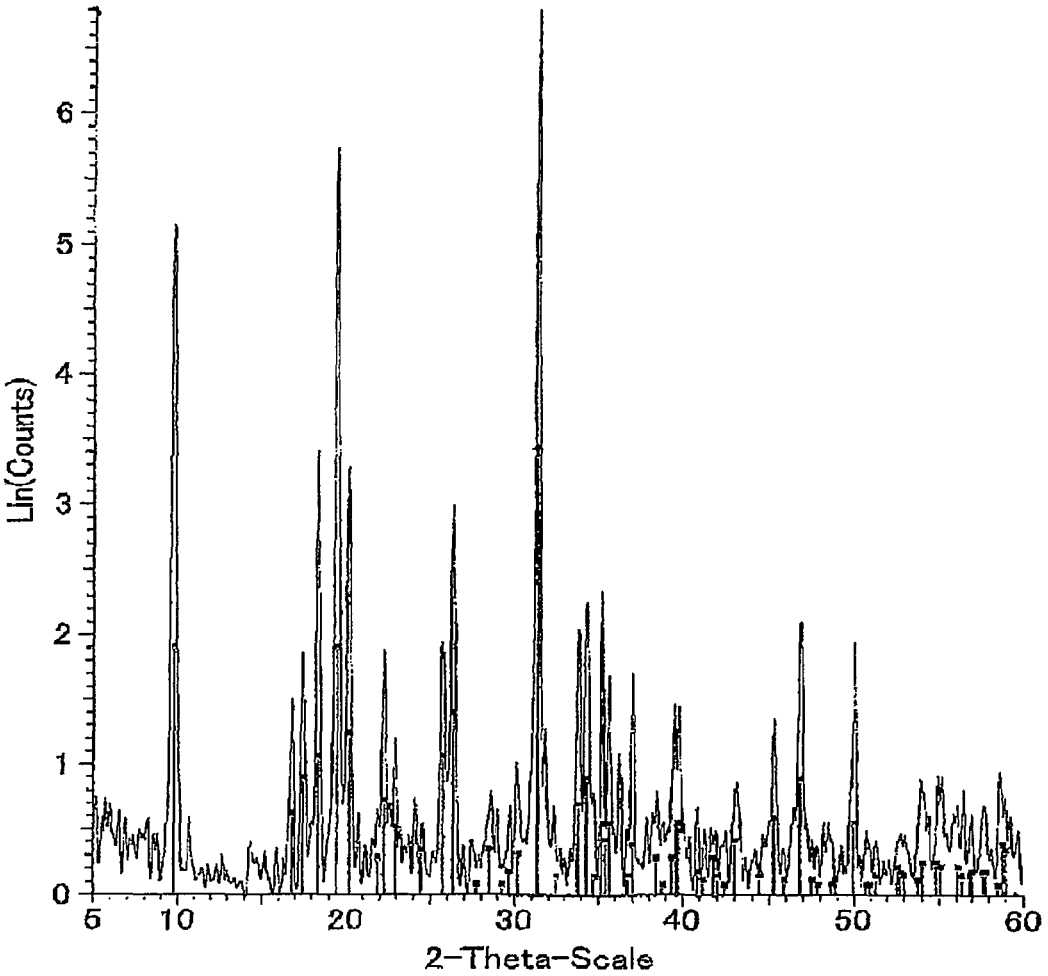
FIG. 8 shows an X-ray diffraction spectrum according to Comparative Example 5.
Figure 9:
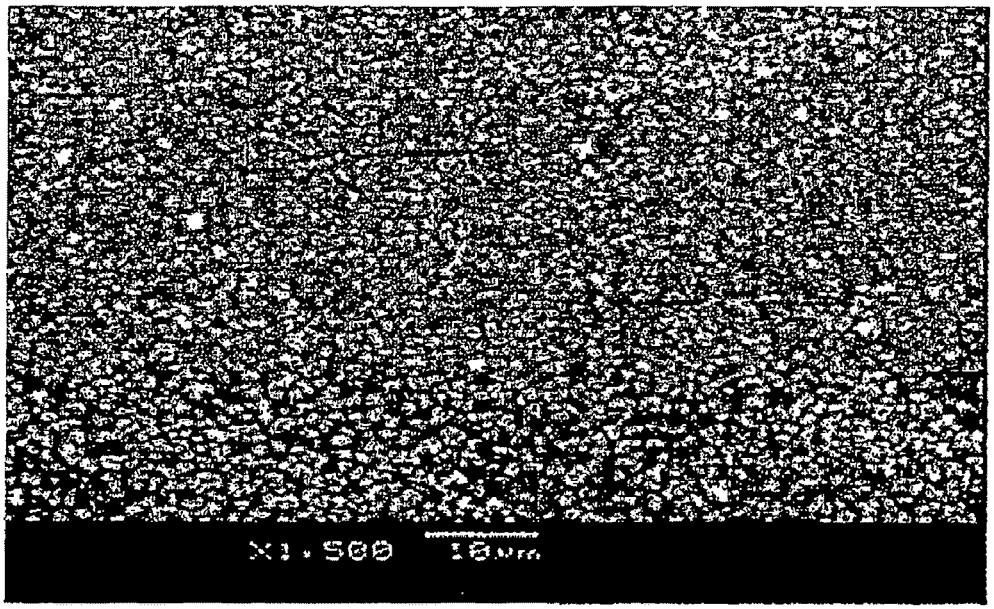
FIG. 9 shows an electron microscope photograph of the chemical conversion coating film formed on the cold-rolled steel sheet, using the surface conditioning composition according to Comparative Example 5.
Figure 10:
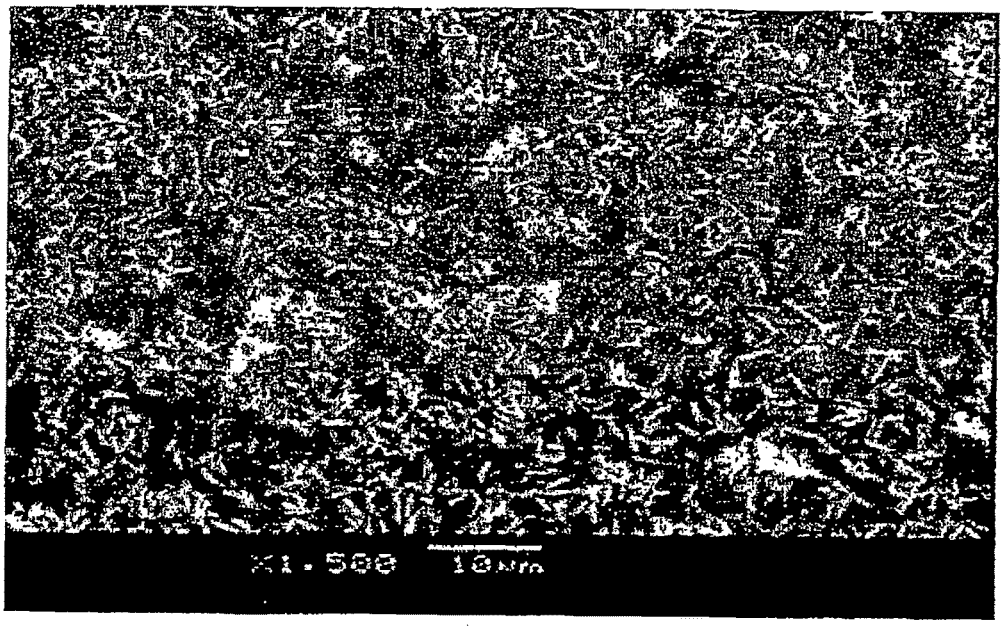
FIG. 10 shows an electron microscope photograph of the chemical conversion coating film formed on the galvanized steel sheet, using the surface conditioning composition according to Comparative Example 5.

MDEA: methyldiothanolamine
DHEA: dimethylethanolamine
DEA: diethanolamine
TEA: triethanolamine
EDA: ethylene diamino
3MPMDMS: 3-mercaptopropylmethyl dimethoxysilane As shown in Table 1, the production of fine particles of zinc phosphate crystal in every Example was ascertained by X-ray diffractometric determination, and the determination of light scattering (as typical examples, X-ray diffraction spectra of Examples 2 to 4 are shown in FIGS. 3 to 5, and the X-ray diffraction spectrum of Comparative Example 5 is shown in FIG. 8). Moreover, it was proven that the dispersion stability of the zinc phosphate particles was extremely favorable, and additionally, the working properties were also satisfactory, as compared with the case in which, the surface conditioning composition of Comparative Example was used. In addition, it was verified that a favorable conversion coating film could be formed on all of the cold-rolled steel sheets, the high-tensile steel sheets, and the aluminum-electrically modified part (as typical examples, electro microscope photograph of chemical conversion film formed on cold-rolled steel sheet and galvanized steel sheet by using the surface conditioning composition of Example 6 are shown in FIGS. 6 and 7, respectively, electro microscope photograph of chemical conversion film formed on cold-rolled steel sheet and galvanized steel sheet by using the surface conditioning composition of Comparative Example 5 are shown in FIGS. 9 and 10, respectively).

The invention claimed is:

1. A surface conditioning composition comprising:

nearly spherical zinc phosphate particles with an average particle diameter from 0.05 μm to 3 μm in a dispersion, wherein the nearly spherical zinc phosphate particles are produced by the process of mixing at least one kind of zinc compound particles with pyrophosphoric acid, the at least one kind of zinc compound particles comprising a member selected from a group consisting of zinc oxide, zinc hydroxide, and basic zinc carbonate, wherein the mixing ratio of the zinc compound particles with the pyrophosphoric acid is in a mass ratio of zinc element/phosphorus element falling within the range of 0.3 to 30, wherein the surface conditioning composition has a pH of from 3 to 12, wherein the surface conditioning composition further comprises at least one of the zinc compound particles, wherein the nearly spherical zinc phosphate particles are obtained by dispersion and stabilization in the presence of an amine compound represented by formula (1):

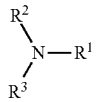

(1)

wherein $R^1$, $R^2$, and $R^3$ each independently represents a hydrogen atom, a straight or branched alkyl group having 1 to 10 carbon atoms, or a straight or branched alkyl group having 1 to 10 carbon atoms having a hydrophilic functional group in a skeleton thereof, wherein not each of $R^1$, $R^2$, and $R^3$ are hydrogen, wherein a saccharide, an organic phosphonic acid, vinyl acetate and polyacrylic acid are not present as a dispersant, wherein the surface conditioning agent further comprises a chelating agent having the ability to bond with the magnesium ions and calcium ions in an aqueous solution, and wherein the nearly spherical zinc phosphate particles have not been pulverized.

2. The surface conditioning composition according to claim 1, wherein the zinc compound particles are zinc oxide.

3. The surface conditioning composition according to claim 1, wherein $R^1$ is hydrogen.

4. The surface conditioning composition according to claim 3, wherein the hydrophilic functional group is a hydroxyl group.

5. The surface conditioning composition according to claim 3, wherein the amine compound is a tertiary alkanolamine.

6. The surface conditioning composition according to claim 1, further comprising at least one selected from a group consisting of an aromatic organic acid, a phenolic compound, and a phenolic resin.

7. The surface conditioning composition according to claim 6, wherein with respect to total content of an aromatic organic acid, a phenolic compound and a phenolic resin, the content of zinc phosphate particles ranges from 0.01% to 1000% by mass on the basis of the mass of the zinc phosphate particles.

8. The surface conditioning composition according to claim 1, further comprising at least one selected from a group consisting of a clay compound, fine particles of an oxide, and a water soluble thickening agent.

9. The surface conditioning composition according to claim 8, wherein with respect to the content of a clay compound, fine particles of an oxide, and a water-soluble thickening agent, the content of zinc phosphate particles ranges from 0.01% to 1000% by mass on the basis of the mass of the zinc phosphate particles.

10. The surface conditioning composition according to claim 1, further comprising at least one selected from a group consisting of a water soluble carboxyl group-containing resin, a saccharide, and a phosphonic acid compound.

11. The surface conditioning composition according to claim 1, further comprising at least one of a chelating agent or a surfactant.

12. The surface conditioning composition according to claim 1, further comprising a member selected from the group consisting of a zirconium complex ion and an oxidized metal ion.

13. The surface conditioning composition according to claim 1, wherein stabilization of the dispersion is possible without using an organic phosphonic acid, a vinyl acetate or a polyacrylic acid as a dispersant.

14. The surface conditioning composition according to claim 1, wherein the oxidized metal ion is selected from the group consisting of Mn, Co, Ni and Ce.

15. The surface conditioning composition according to claim 1, wherein the dispersion liquid does not include any dispersion solvent other than water.

16. The surface conditioning composition according to claim 1, wherein a content of the organic solvent is no more than 10% by mass.

17. The surface conditioning composition according to claim 1, wherein the content of zinc phosphate particles is, with respect to the content of the amine compound, from 0.01% by mass to 1000% by mass on the basis of the mass of the zinc phosphate particles.

18. The surface conditioning composition of claim 1 wherein the chelating agent is selected from the group consisting of citric acid, tartaric acid, EDTA, gluconic acid, succinic acid, malic acid, and compounds and derivatives thereof.

19. A method comprising bringing a surface conditioning composition according to claim 1 into contact with the surface of the metal.

20. A surface conditioning composition comprising:

at least one member selected from the group consisting of an aromatic organic acid, a phenolic compound, a phenolic resin, nearly spherical zinc phosphate particles with an average particle diameter from 0.05 μm to 3 μm in a dispersion, wherein the nearly spherical zinc phosphate particles have not been pulverized, wherein the nearly spherical zinc phosphate particles are produced by the process of mixing at least one kind of zinc compound particles with pyrophosphoric acid, the at least one kind of zinc particles comprising a member selected from a group consisting of zinc oxide, zinc hydroxide, and basic zinc carbonate, wherein the surface conditioning composition has a pH of from 3 to 12, wherein the surface conditioning composition further comprises at least one of the zinc compound particles, wherein the mixing ratio of the zinc compound particles with the pyrophosphoric acid is in a mass ratio of the zinc element/phosphorus element falling within the range of 0.3 to 30, wherein a saccharide, an organic phosphonic acid, vinyl acetate and polyacrylic acid are not present as a dispersant, and wherein the surface conditioning agent further comprises a chelating agent having the ability to bond with the magnesium ions and calcium ions in an aqueous solution.

21. A surface conditioning composition comprising:

water;

at least one member selected from the group consisting of an aromatic organic acid, a phenolic compound, a phenolic resin; and nearly spherical zinc phosphate particles with an average particle diameter from 0.05 μm to 3 μm, wherein the nearly spherical zinc phosphate particles have not been pulverized;

wherein the surface conditioning composition has a pH of from 3 to 12, wherein the surface conditioning composition further comprises at least one of said zinc compound particles, wherein the mixing ratio of the zinc compound particles with the pyrophosphoric acid is in a mass ratio of the zinc element/phosphorus element falling within the range of 0.3 to 30, wherein a saccharide, an organic phosphonic acid, vinyl acetate and polyacrylic acid are not present as a dispersant, wherein the surface conditioning composition is a dispersion, and wherein the surface conditioning agent further comprises a chelating agent having the ability to bond with the magnesium ions and calcium ions in an aqueous solution.

22. A surface conditioning composition comprising:

water;

at least one member selected from the group consisting of a clay compound, a fine oxide particle and a water soluble thickening agent; and nearly spherical zinc phosphate particles with an average particle diameter from 0.05 μm to 3 μm, wherein the nearly spherical zinc phosphate particles have not been pulverized and are produced by the process of mixing at least one kind of zinc compound particles with pyrophosphoric acid, the at least one kind of zinc compound particles comprising a member selected from a group consisting of zinc oxide, zinc hydroxide, and basic zinc carbonate;

wherein the surface conditioning composition has a pH of from 3 to 12, wherein the surface conditioning composition further comprises at least one of said zinc compound particles, wherein the mixing ratio of the zinc compound particles with the pyrophosphoric acid is in a mass ratio of the zinc element/phosphorus element falling within the range of 0.3 to 30, wherein a saccharide, an organic phosphonic acid, vinyl acetate and polyacrylic acid are not present as a dispersant, wherein the surface conditioning composition is a dispersion, and wherein the surface conditioning agent further comprises a chelating agent having the ability to bond with the magnesium ions and calcium ions in an aqueous solution.

23. A surface conditioning composition comprising:

water;

at least one member selected from the group consisting of a water soluble carboxyl group-consisting of a resin and a phosphonic acid compound; and nearly spherical zinc phosphate particles with an average particle diameter from 0.05 μm to 3 wherein the nearly spherical zinc phosphate particles have not been pulverized and are produced by the process of mixing at least one kind of zinc compound particles with pyrophosphoric acid, the at least one kind of zinc compound particles comprising a member selected from a group consisting of zinc oxide, zinc hydroxide, and basic zinc carbonate;

wherein the surface conditioning composition has a pH of from 3 to 12, wherein the surface conditioning composition further comprises at least one of said zinc compound particles, wherein the mixing ratio of the zinc compound particles with the pyrophosphoric acid is in a mass ratio of the zinc element/phosphorus element falling within the range of 0.3 to 30, wherein a saccharide, an organic phosphonic acid, vinyl acetate and polyacrylic acid are not present as a dispersant, wherein the surface conditioning composition is a dispersion dispersant, and wherein the surface conditioning agent further comprises a chelating agent having the ability to bond with the magnesium ions and calcium ions in an aqueous solution.

24. A surface conditioning composition comprising:

water;

at least one member selected from the group consisting of a water soluble carboxyl group-consisting of a resin and a phosphonic acid compound; and nearly spherical zinc phosphate particles with an average particle diameter from 0.05 μm to 3 wherein the nearly spherical zinc phosphate particles have not been pulverized and are produced by the process of mixing at least one kind of zinc compound particles with pyrophosphoric acid, the at least one kind of zinc compound particles comprising a member selected from a group consisting of zinc hydroxide, and basic zinc carbonate;

wherein the surface conditioning composition has a pH of from 3 to 12, wherein the surface conditioning composition further comprises at least one of said zinc compound particles, and wherein the mixing ratio of the zinc compound particles with the pyrophosphoric acid is in a mass ratio of the zinc element/phosphorus element falling within the range of 0.3 to 30, wherein an organic phosphonic acid, vinyl acetate and polyacrylic acid are not present as a dispersant, wherein the surface conditioning composition is a dispersion dispersant, and wherein the surface conditioning agent further comprises a chelating agent having the ability to bond with the magnesium ions and calcium ions in an aqueous solution.

25. A method for production of a surface conditioning composition comprising the steps of:

mixing at least one kind of zinc compound particle selected from the group consisting of zinc oxide, zinc hydroxide, and basic zinc carbonate, with pyrophosphoric acid, adding a chelating agent having the ability to bond with the magnesium ions and calcium ions in an aqueous solution, allowing for a reaction in an acidic aqueous solution having a pH lower than 7 to produce nearly spherical zinc phosphate particles with an average particle diameter from 0.05 μm to 3 μm, and dispersing and stabilizing the resulting particles by a disperser, wherein the nearly spherical zinc phosphate particles have not been pulverized, wherein the mixing ratio of the zinc compound particles with the pyrophosphoric acid is in a mass ratio of zinc element/phosphorus element falling within the range of 0.3 to 30, wherein the nearly spherical zinc phosphate particles are obtained by dispersion and stabilization in the presence of an amine compound represented by formula (1):

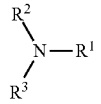

(1)

in which $R^1$, $R^2$, and $R^3$ each independently represents a hydrogen atom, a straight or branched alkyl group having 1 to 10 carbon atoms, or a straight or branched alkyl group having 1 to 10 carbon atoms having a hydrophilic functional group in a skeleton thereof, wherein not each of $R^1$, $R^2$, and $R^3$ are hydrogen, and wherein a saccharide, an organic phosphonic acid, vinyl acetate and polyacrylic acid are not present as a dispersant.

26. The method of claim 25, wherein the disperser is selected from the group consisting of a bead mill, a high-pressure homogenizer, or an ultrasonic disperser.

* * * * *